US012258723B2

(12) United States Patent
Greci et al.

(10) Patent No.: US 12,258,723 B2
(45) **Date of Patent: *Mar. 25, 2025**

(54) EXPANDING METAL USED IN FORMING SUPPORT STRUCTURES

(71) Applicant: Halliburton Energy Services, Inc., Houston, TX (US)

(72) Inventors: Stephen Michael Greci, Carrollton, TX (US); Luke William Holderman, Carrollton, TX (US); Brandon T. Least, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/342,069

(22) Filed: Jun. 27, 2023

(65) Prior Publication Data

US 2023/0332370 A1 Oct. 19, 2023

Related U.S. Application Data

(63) Continuation of application No. 17/335,216, filed on Jun. 1, 2021, now Pat. No. 11,697,915.

(51) Int. Cl.

| | |
|---|---|
| ***E02D 27/52*** | (2006.01) |
| ***E01D 19/02*** | (2006.01) |
| ***E02D 5/30*** | (2006.01) |
| ***E02D 5/40*** | (2006.01) |
| ***E02D 5/52*** | (2006.01) |

(52) U.S. Cl.

CPC ..... *E02D 27/525* (2013.01); *E02D 5/30* (2013.01); *E02D 5/40* (2013.01); *E02D 5/523* (2013.01); *E01D 19/02* (2013.01); *E02D 2200/1685* (2013.01); *E02D 2300/002* (2013.01); *E02D 2300/0029* (2013.01); *E02D 2300/0045* (2013.01); *E02D 2300/0051* (2013.01)

(58) Field of Classification Search

CPC .. E02D 5/30; E02D 5/40; E02D 5/523; E02D 27/525; E01D 19/02

See application file for complete search history.

(56) References Cited

U.S. PATENT DOCUMENTS 975,514 A * 11/1910 Cummings ..... E02D 5/30 405/256

1,525,740 A 2/1925 Howard (Continued)

FOREIGN PATENT DOCUMENTS

CA 2820742 A1 9/2013

CN 203308412 U 11/2013

(Continued)

*Primary Examiner* — Frederick L Lagman

(74) *Attorney, Agent, or Firm* — Scott Richardson; Parker Justiss, P.C.

(57) ABSTRACT

Provided is a support structure and a method for manufacture thereof. The support structure, in one aspect, includes first and second expanded metal structural pillars positioned within the ground by a distance ($d_1$), the first and second expanded metal structural pillars comprising a metal that has expanded in response to hydrolysis. In at least one other aspect, the support structure includes one or more beams spanning the first and second expanded metal structural pillars.

31 Claims, 16 Drawing Sheets

(56) References Cited

U.S. PATENT DOCUMENTS 2,075,912 A 4/1937 Roye
2,590,931 A 4/1952 Cabaniss
2,743,781 A 5/1956 Lane
2,865,454 A 12/1958 Richards
3,206,536 A 9/1965 Goodloe
3,371,716 A 3/1968 Current
3,616,354 A 10/1971 Russell
3,706,125 A 12/1972 Hopkins
4,270,608 A 6/1981 Hendrickson
4,424,859 A 1/1984 Sims
4,424,861 A 1/1984 Carter
4,442,908 A 4/1984 Steenbock
4,446,932 A 5/1984 Hipp
4,457,379 A 7/1984 McStravick
4,527,815 A 7/1985 Frick
4,977,636 A 12/1990 King
4,979,585 A 12/1990 Chesnutt
5,139,274 A 8/1992 Oseman
5,220,959 A 6/1993 Vance
5,424,139 A 6/1995 Shuler
5,492,173 A 2/1996 Kilgore
5,517,981 A 5/1996 Taub et al.
5,662,341 A 9/1997 Ezell et al.
5,667,015 A 9/1997 Harestad
5,803,173 A 9/1998 Fraser et al.
6,089,320 A 7/2000 LaGrange
6,106,024 A 8/2000 Herman et al.
6,840,325 B2 1/2005 Stephenson
6,907,930 B2 6/2005 Cavender
6,942,039 B2 9/2005 Tinker
7,104,322 B2 9/2006 Whanger et al.
7,152,687 B2 12/2006 Gano
7,322,408 B2 1/2008 Howlett
7,347,274 B2 3/2008 Patel
7,350,590 B2 4/2008 Hosie et al.
7,402,277 B2 7/2008 Ayer
7,578,043 B2 8/2009 Simpson et al.
7,673,688 B1 3/2010 Jones
7,677,303 B2 3/2010 Coronado
7,696,275 B2 4/2010 Slay et al.
7,963,321 B2 6/2011 Kutac
7,996,945 B2 8/2011 Nosker
8,042,841 B2 10/2011 Viegener
8,109,339 B2 2/2012 Xu
8,225,861 B2 7/2012 Foster et al.
8,266,751 B2 9/2012 He
8,430,176 B2 4/2013 Xu
8,453,736 B2 6/2013 Constantine
8,459,367 B2 6/2013 Nutley et al.
8,469,084 B2 6/2013 Clark et al.
8,490,707 B2 7/2013 Robisson
8,579,024 B2 11/2013 Mailand et al.
8,684,096 B2 4/2014 Harris
8,794,330 B2 8/2014 Stout
8,807,209 B2 8/2014 King
8,875,800 B2 11/2014 Wood et al.
8,894,070 B2 11/2014 Bhat et al.
8,993,491 B2 3/2015 James
9,004,173 B2 4/2015 Richard
9,217,311 B2 12/2015 Slup
9,249,904 B2 2/2016 Duquette
9,279,295 B2 3/2016 Williamson et al.
9,347,272 B2 5/2016 Hewson et al.
9,353,606 B2 5/2016 Bruce et al.
9,393,601 B2 7/2016 Ranck
9,404,030 B2 8/2016 Mazyar
9,534,460 B2 1/2017 Watson et al.
9,611,715 B1 4/2017 Smith
9,644,459 B2 5/2017 Themig
9,708,880 B2 7/2017 Solhaug
9,725,979 B2 8/2017 Mazyar et al.
9,732,578 B2 8/2017 McRobb
9,745,451 B2 8/2017 Zhao et al.
9,765,595 B2 9/2017 Themig et al.
9,771,510 B2 9/2017 James et al.
9,945,190 B2 4/2018 Crowley
9,976,380 B2 5/2018 Davis et al.
9,976,381 B2 5/2018 Martin et al.
10,030,467 B2 7/2018 Al-Gouhi
10,060,225 B2 8/2018 Wolf
10,119,011 B2 11/2018 Zhao et al.
10,179,873 B1 1/2019 Meng
10,316,601 B2 6/2019 Walton et al.
10,337,298 B2 7/2019 Braddick
10,344,570 B2 7/2019 Steele
10,352,109 B2 7/2019 Sanchez
10,364,636 B2 7/2019 Davis
10,472,933 B2 11/2019 Steele
10,533,392 B2 1/2020 Walton et al.
10,718,183 B2 7/2020 Bruce et al.
10,758,974 B2 9/2020 Sherman
10,794,152 B2 10/2020 Lang et al.
10,961,804 B1 3/2021 Fripp
11,359,448 B2 6/2022 Fripp
11,365,611 B2 6/2022 Gibb
11,428,066 B2 8/2022 Andersen
11,512,552 B2 11/2022 Fripp
11,697,915 B2 * 7/2023 Greci ..... E02D 5/40 405/228
2002/0088616 A1 7/2002 Swor et al.
2003/0132001 A1 7/2003 Wilson
2003/0164236 A1 9/2003 Thornton
2003/0164237 A1 9/2003 Butterfield, Jr.
2003/0205377 A1 11/2003 Streater
2004/0194970 A1 10/2004 Eatwell
2005/0051333 A1 3/2005 Weber
2005/0061369 A1 3/2005 De Almeida
2005/0072576 A1 4/2005 Henriksen
2005/0093250 A1 5/2005 Santi et al.
2005/0199401 A1 9/2005 Patel et al.
2006/0144591 A1 7/2006 Gonzalez
2006/0272806 A1 12/2006 Wilkie et al.
2007/0089875 A1 4/2007 Steele et al.
2007/0089910 A1 4/2007 Hewson et al.
2007/0095532 A1 5/2007 Head
2007/0137826 A1 6/2007 Bosma et al.
2007/0144734 A1 6/2007 Xu et al.
2007/0151724 A1 7/2007 Ohmer et al.
2007/0163781 A1 7/2007 Walker
2007/0221387 A1 9/2007 Levy
2007/0246213 A1 10/2007 Hailey
2007/0267824 A1 11/2007 Baugh et al.
2007/0277979 A1 12/2007 Todd et al.
2008/0047708 A1 2/2008 Spencer
2008/0135249 A1 6/2008 Fripp
2008/0149351 A1 6/2008 Marya
2008/0290603 A1 11/2008 Laflin
2009/0014173 A1 1/2009 Macleod
2009/0084555 A1 4/2009 Lee
2009/0102133 A1 4/2009 Ruddock
2009/0159278 A1 6/2009 Corre
2009/0200028 A1 8/2009 Dewar
2009/0250227 A1 10/2009 Brown et al.
2009/0250228 A1 10/2009 Loretz
2009/0272546 A1 11/2009 Nutley et al.
2009/0321087 A1 12/2009 Victorov
2010/0072711 A1 3/2010 Doane
2010/0078173 A1 4/2010 Buytaert et al.
2010/0096143 A1 4/2010 Angman
2010/0108148 A1 5/2010 Chen
2010/0122819 A1 5/2010 Wildman
2010/0139930 A1 6/2010 Patel
2010/0155083 A1 6/2010 Lynde et al.
2010/0181080 A1 7/2010 Levy
2010/0225107 A1 9/2010 Tverlid
2010/0257913 A1 10/2010 Storm, Jr. et al.
2010/0307737 A1 12/2010 Mellemstrand
2011/0061876 A1 3/2011 Johnson et al.
2011/0098202 A1 4/2011 James
2011/0147014 A1 6/2011 Chen et al.
2012/0018143 A1 1/2012 Lembcke
2012/0048531 A1 3/2012 Marzouk
2012/0048561 A1 3/2012 Holderman
2012/0048623 A1 3/2012 Lafuente et al.

(56) References Cited

U.S. PATENT DOCUMENTS

| | | | |
|---|---|---|---|
| 2012/0049462 | A1 | 3/2012 | Pitman |
| 2012/0168147 | A1 | 7/2012 | Bowersock |
| 2012/0175134 | A1 | 7/2012 | Robisson |
| 2012/0273236 | A1 | 11/2012 | Gandikota et al. |
| 2013/0048289 | A1 | 2/2013 | Mazyar et al. |
| 2013/0056207 | A1 | 3/2013 | Wood et al. |
| 2013/0081815 | A1 | 4/2013 | Mazyar et al. |
| 2013/0152824 | A1 | 6/2013 | Crews |
| 2013/0153236 | A1 | 6/2013 | Bishop |
| 2013/0161006 | A1 | 6/2013 | Robisson et al. |
| 2013/0186615 | A1 | 7/2013 | Hallunbaek et al. |
| 2013/0192853 | A1 | 8/2013 | Themig |
| 2013/0292117 | A1 | 11/2013 | Robisson |
| 2014/0026335 | A1 | 1/2014 | Smith |
| 2014/0034308 | A1 | 2/2014 | Holderman |
| 2014/0051612 | A1 | 2/2014 | Mazyar |
| 2014/0262352 | A1 | 9/2014 | Lembcke |
| 2015/0021049 | A1 | 1/2015 | Davis et al. |
| 2015/0075768 | A1 | 3/2015 | Wright et al. |
| 2015/0101813 | A1 | 4/2015 | Zhao |
| 2015/0113913 | A1 | 4/2015 | Kim |
| 2015/0184486 | A1 | 7/2015 | Epstein |
| 2015/0233190 | A1 | 8/2015 | Wolf et al. |
| 2015/0275587 | A1 | 10/2015 | Wolf et al. |
| 2015/0337615 | A1 | 11/2015 | Epstein et al. |
| 2015/0345248 | A1 | 12/2015 | Carragher |
| 2015/0368990 | A1 | 12/2015 | Jewett |
| 2015/0369003 | A1 | 12/2015 | Hajjari et al. |
| 2016/0024896 | A1 | 1/2016 | Johnson et al. |
| 2016/0024902 | A1 | 1/2016 | Richter |
| 2016/0137912 | A1 | 5/2016 | Sherman et al. |
| 2016/0138359 | A1 | 5/2016 | Zhao |
| 2016/0145488 | A1 | 5/2016 | Aines et al. |
| 2016/0145968 | A1 | 5/2016 | Marya |
| 2016/0177668 | A1 | 6/2016 | Watson et al. |
| 2016/0194936 | A1 | 7/2016 | Allen |
| 2016/0208569 | A1 | 7/2016 | Anderson et al. |
| 2016/0230495 | A1 | 8/2016 | Mazyar et al. |
| 2016/0273312 | A1 | 9/2016 | Steele et al. |
| 2016/0319633 | A1 | 11/2016 | Cooper et al. |
| 2016/0326830 | A1 | 11/2016 | Hallundbaek |
| 2016/0326849 | A1 | 11/2016 | Bruce |
| 2016/0333187 | A1 | 11/2016 | Bauer et al. |
| 2017/0015824 | A1 | 1/2017 | Gozalo |
| 2017/0022778 | A1 | 1/2017 | Fripp et al. |
| 2017/0107419 | A1 | 4/2017 | Roy et al. |
| 2017/0107794 | A1 | 4/2017 | Steele |
| 2017/0113275 | A1 | 4/2017 | Roy et al. |
| 2017/0159401 | A1 | 6/2017 | Saltel et al. |
| 2017/0175487 | A1 | 6/2017 | Marcin et al. |
| 2017/0175488 | A1 | 6/2017 | Lisowski |
| 2017/0191342 | A1 | 7/2017 | Turley |
| 2017/0198191 | A1 | 7/2017 | Potapenko |
| 2017/0234103 | A1 | 8/2017 | Frazier |
| 2017/0306714 | A1 | 10/2017 | Haugland |
| 2017/0314372 | A1 | 11/2017 | Tolman |
| 2017/0350237 | A1 | 12/2017 | Giem et al. |
| 2017/0356266 | A1 | 12/2017 | Arackakudiyil |
| 2018/0023362 | A1 | 1/2018 | Makowiecki et al. |
| 2018/0023366 | A1 | 1/2018 | Deng et al. |
| 2018/0038193 | A1 | 2/2018 | Walton |
| 2018/0080304 | A1 | 3/2018 | Cortez et al. |
| 2018/0081468 | A1 | 3/2018 | Bruce et al. |
| 2018/0086894 | A1 | 3/2018 | Roy |
| 2018/0087350 | A1 | 3/2018 | Sherman |
| 2018/0094508 | A1 | 4/2018 | Smith et al. |
| 2018/0100367 | A1 | 4/2018 | Perez |
| 2018/0128072 | A1 | 5/2018 | Larsen |
| 2018/0128082 | A1 | 5/2018 | Hollan et al. |
| 2018/0209234 | A1 | 7/2018 | Manera |
| 2018/0223624 | A1 | 8/2018 | Fripp |
| 2018/0298708 | A1 | 10/2018 | Schmidt et al. |
| 2018/0334882 | A1 | 11/2018 | Brandsdal |
| 2018/0347288 | A1 | 12/2018 | Fripp |
| 2018/0363409 | A1 | 12/2018 | Frazier |
| 2019/0016951 | A1 | 1/2019 | Sherman et al. |
| 2019/0032435 | A1 | 1/2019 | Kochanek et al. |
| 2019/0039126 | A1 | 2/2019 | Sherman |
| 2019/0078414 | A1 | 3/2019 | Frazier |
| 2019/0128092 | A1 | 5/2019 | Mueller et al. |
| 2019/0136666 | A1 | 5/2019 | Kent |
| 2019/0178054 | A1 | 6/2019 | Bruce |
| 2019/0186228 | A1 | 6/2019 | Beckett et al. |
| 2019/0225861 | A1 | 7/2019 | Reddy |
| 2019/0249510 | A1 | 8/2019 | Deng et al. |
| 2019/0316025 | A1 | 10/2019 | Sherman |
| 2019/0383115 | A1 | 12/2019 | Lees |
| 2020/0032574 | A1 | 1/2020 | Fripp et al. |
| 2020/0056435 | A1 | 2/2020 | Sherman |
| 2020/0072019 | A1 | 3/2020 | Onti et al. |
| 2020/0080401 | A1 | 3/2020 | Sherman |
| 2020/0080402 | A1 | 3/2020 | Lang et al. |
| 2020/0240235 | A1 | 7/2020 | Fripp et al. |
| 2020/0308945 | A1 | 10/2020 | Surjaatmadja et al. |
| 2020/0325749 | A1 | 10/2020 | Fripp et al. |
| 2020/0362224 | A1 | 11/2020 | Wellhoefer |
| 2020/0370391 | A1 | 11/2020 | Fripp et al. |
| 2021/0017835 | A1 | 1/2021 | Pelto et al. |
| 2021/0040810 | A1 | 2/2021 | Evers |
| 2021/0123310 | A1 | 4/2021 | Fripp et al. |
| 2021/0123319 | A1 | 4/2021 | Greci |
| 2021/0172286 | A1 | 6/2021 | Barlow |
| 2021/0187604 | A1 | 6/2021 | Sherman et al. |
| 2021/0270093 | A1 | 9/2021 | Fripp |
| 2021/0270103 | A1 | 9/2021 | Greci et al. |
| 2021/0332673 | A1 | 10/2021 | Fripp |
| 2021/0363849 | A1 | 11/2021 | Al Yahya |
| 2022/0106847 | A1 | 4/2022 | Dahl |
| 2022/0186575 | A1 | 6/2022 | Fripp |
| 2022/0205336 | A1 | 6/2022 | Asthana |
| 2022/0372837 | A1 | 11/2022 | Holderman et al. |

FOREIGN PATENT DOCUMENTS

| | | | |
|---|---|---|---|
| CN | 205422632 | U | 8/2016 |
| CN | 107148444 | A | 9/2017 |
| CN | 108194756 | A | 6/2018 |
| CN | 107148444 | B | 1/2019 |
| CN | 108194756 | B | 8/2020 |
| EP | 15726 | A1 | 9/1980 |
| EP | 869257 | A2 | 10/1998 |
| EP | 940558 | A1 | 9/1999 |
| EP | 0940558 | B1 | 1/2005 |
| EP | 1757770 | A1 | 2/2007 |
| EP | 1910728 | A1 | 4/2008 |
| EP | 1910728 | B1 | 9/2009 |
| EP | 2447466 | A2 | 5/2012 |
| EP | 2501890 | A2 | 9/2012 |
| EP | 2501890 | B | 7/2014 |
| EP | 2447466 | A3 | 3/2017 |
| EP | 3144018 | A1 | 3/2017 |
| EP | 3144018 | A4 | 5/2017 |
| EP | 3196402 | A1 | 7/2017 |
| EP | 3144018 | B1 | 9/2018 |
| EP | 2447466 | B1 | 10/2018 |
| GB | 2444060 | A | 5/2008 |
| GB | 2444060 | B | 12/2008 |
| JP | 2003090037 | A | 3/2003 |
| JP | 2003293354 | A | 10/2003 |
| JP | 2004169303 | A | 6/2004 |
| JP | 2015175449 | A | 10/2015 |
| KR | 20020014619 | A | 2/2002 |
| KR | 20080096576 | A | 10/2008 |
| WO | 02/02900 | A2 | 1/2002 |
| WO | 02/02900 | A3 | 5/2002 |
| WO | 02/02900 | A8 | 12/2003 |
| WO | 2005/022012 | A1 | 3/2005 |
| WO | 2006/045794 | A1 | 5/2006 |
| WO | 2007/047089 | A1 | 4/2007 |
| WO | 2012/094322 | A2 | 7/2012 |
| WO | 2012/125660 | A2 | 9/2012 |
| WO | 2012/094322 | A3 | 10/2012 |
| WO | 2012/125660 | A3 | 2/2013 |
| WO | 2014/028149 | A1 | 2/2014 |

(56) References Cited

FOREIGN PATENT DOCUMENTS

| | | | |
|---|---|---|---|
| WO | 2014/182301 | A1 | 11/2014 |
| WO | 2014/193042 | A1 | 12/2014 |
| WO | 2015/057338 | A1 | 4/2015 |
| WO | 2015/069886 | A2 | 5/2015 |
| WO | 2015/069886 | A3 | 9/2015 |
| WO | 2015/183277 | A1 | 12/2015 |
| WO | 2016/000068 | A1 | 1/2016 |
| WO | 2016/171666 | A1 | 10/2016 |
| WO | 2017/100417 | A1 | 6/2017 |
| WO | 2018/055382 | A1 | 3/2018 |
| WO | 2019/094044 | A1 | 5/2019 |
| WO | 2019/122857 | A1 | 6/2019 |
| WO | 2019/147285 | A1 | 8/2019 |
| WO | 2019/151870 | A1 | 8/2019 |
| WO | 2019/164499 | A1 | 8/2019 |
| WO | 2020/005252 | A1 | 1/2020 |
| WO | 2020/141203 | A1 | 7/2020 |
| WO | 2019/164499 | A8 | 8/2020 |
| WO | 2020/167288 | A1 | 8/2020 |
| WO | 2020/204940 | A1 | 10/2020 |
| WO | 2021/034325 | A1 | 2/2021 |
| WO | 2021/086317 | A1 | 5/2021 |
| WO | 2021/096519 | A1 | 5/2021 |
| WO | 2021/126279 | A1 | 6/2021 |

* cited by examiner

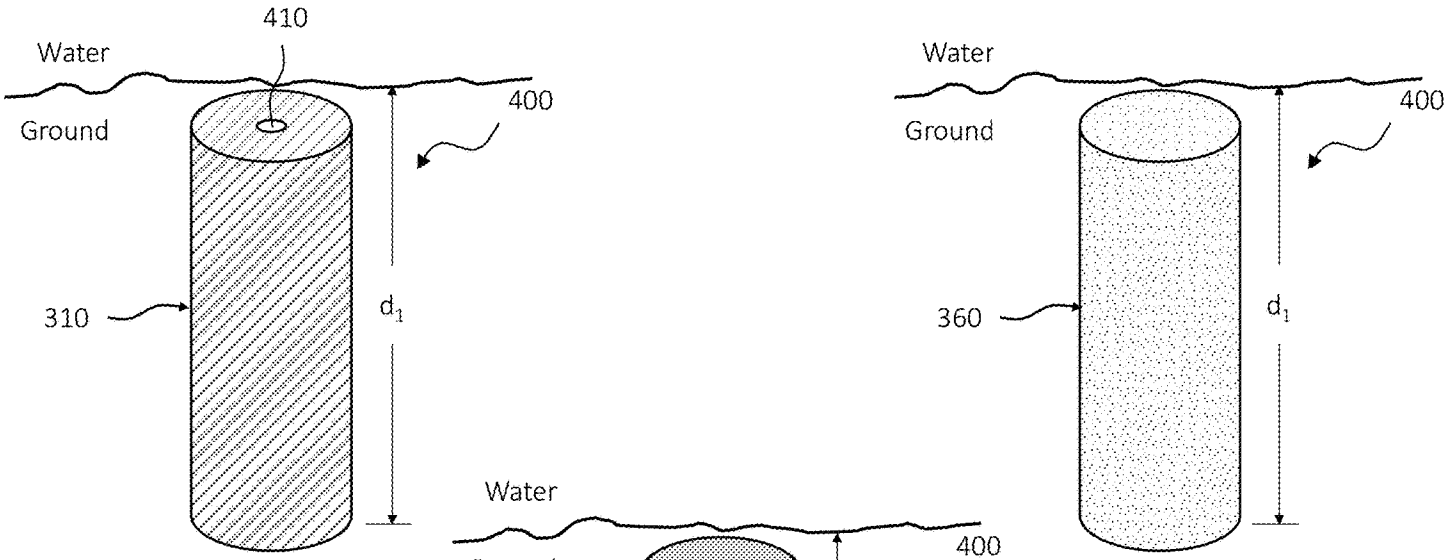
FIG. 4A
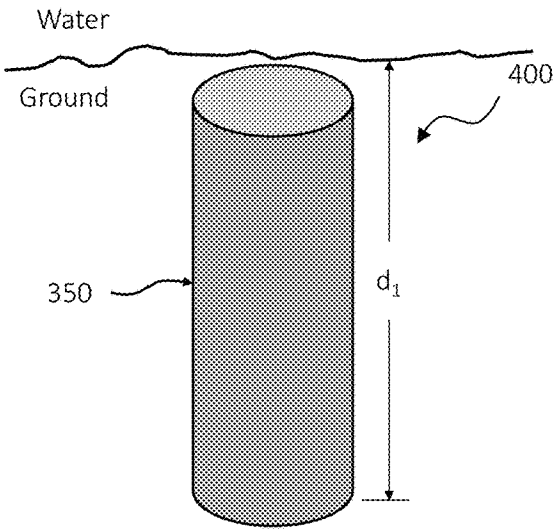
FIG. 4B
FIG. 4C

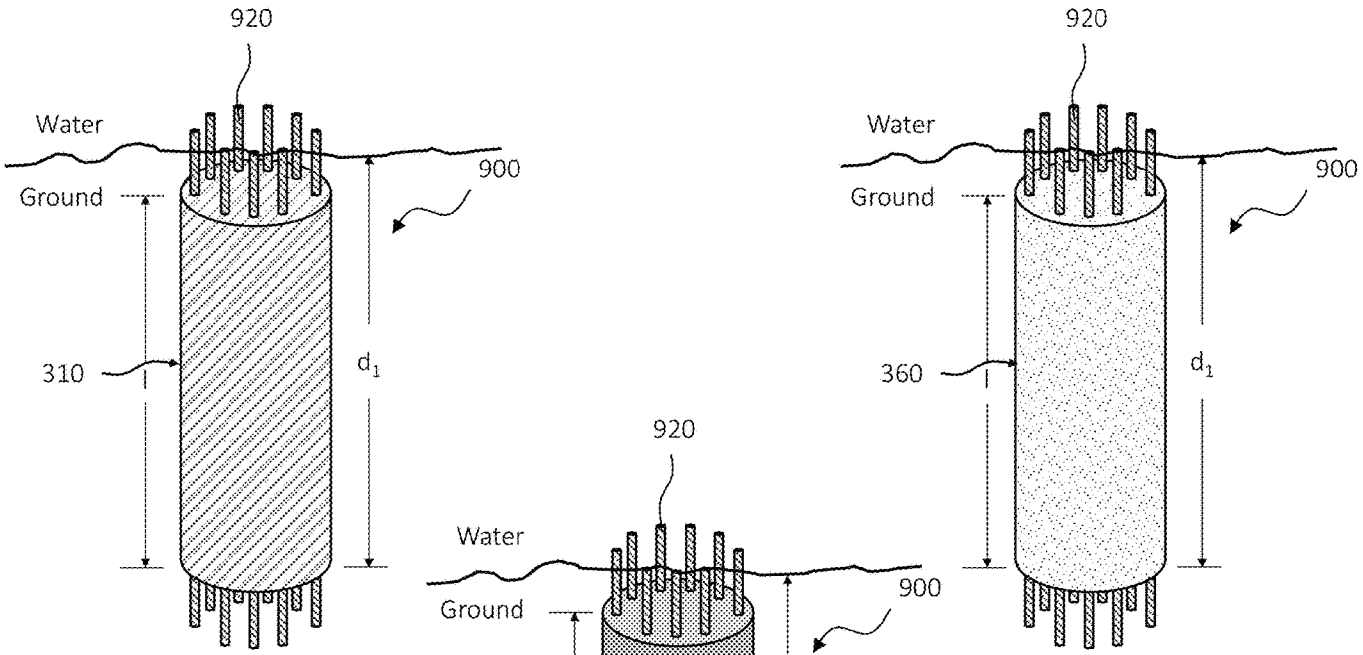
FIG. 9A
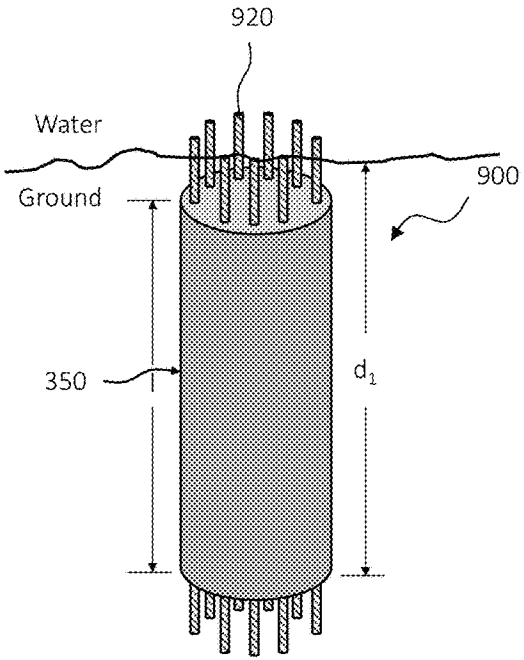
FIG. 9B
FIG. 9C

EXPANDING METAL USED IN FORMING SUPPORT STRUCTURES

CROSS-REFERENCE TO RELATED APPLICATION

This application is a continuation of U.S. patent application Ser. No. 17/335,216, entitled "EXPANDING METAL USED IN FORMING SUPPORT STRUCTURES", filed on Jun. 1, 2021. and which has issued into U.S. Pat. No. 11,697,915. The above-listed application is commonly assigned with the present application and is incorporated herein by reference as if reproduced herein in its entirety.

BACKGROUND

Structural pillars are often used as underwater support features for over water bridges and other transportation structures. Often, at least a portion of the underwater support feature comprises cement, or another similar material. There is great expense when deploying cement in underwater applications. One significant expense relates to the pumping equipment used to deploy the un-cured cement to its underwater location. Another expense relates to the cofferdams or other containment equipment and methods required to properly cure the un-cured cement in underwater applications. These expenses, among others, greatly increase the cost associated with the deployment and use of underwater structural pillars.

BRIEF DESCRIPTION

Reference is now made to the following descriptions taken in conjunction with the accompanying drawings, in which:

FIGS. 4A through 4C depict various different manufacturing states for a structural pillar designed, manufactured, and operated according to an alternative embodiment of the disclosure;

FIGS. 9A through 9C depict various different manufacturing states for a structural pillar designed, manufactured, and operated according to an alternative embodiment of the disclosure;

DETAILED DESCRIPTION

Figure 1:
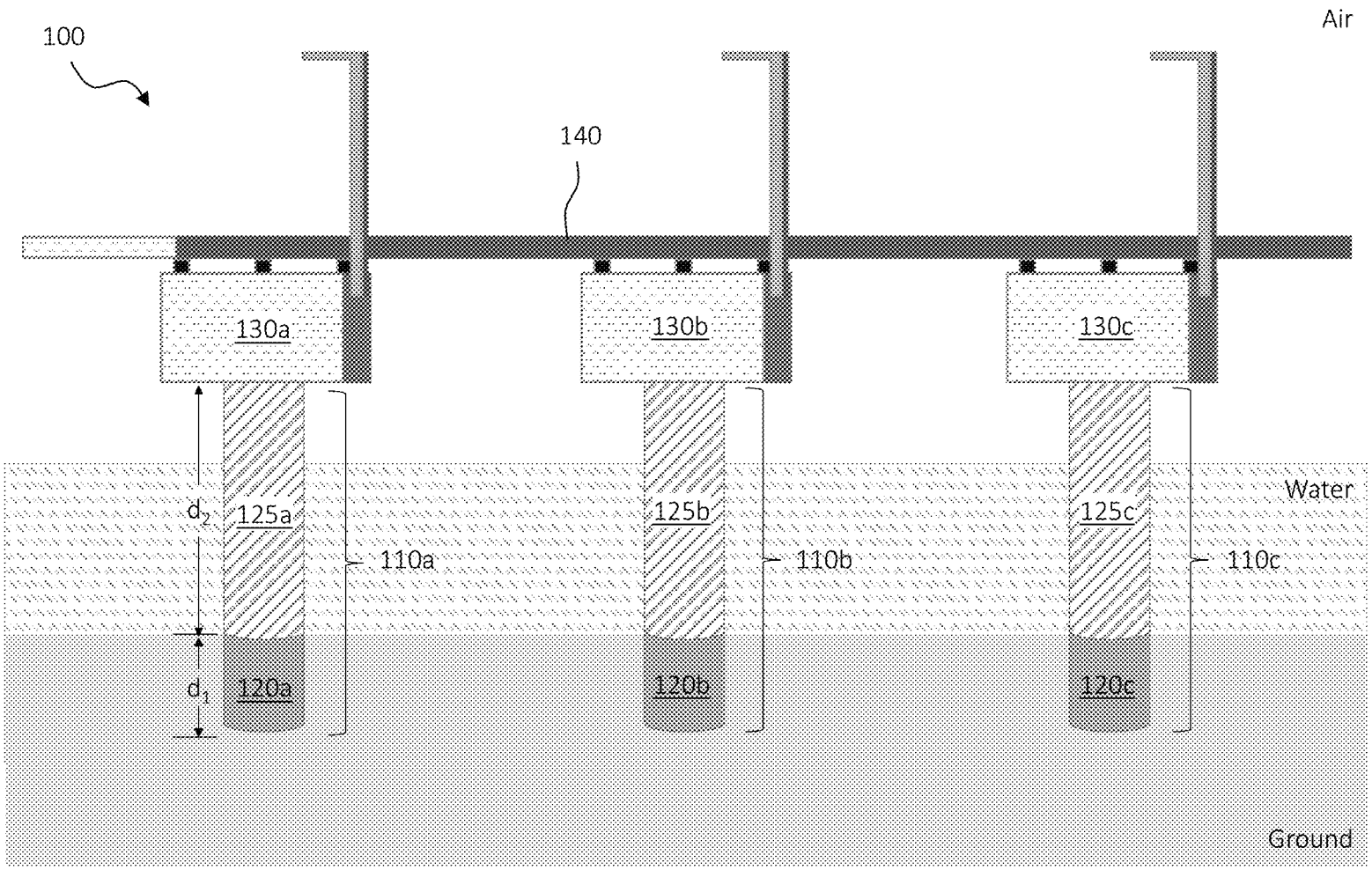
FIG. 1 depicts a support structure designed, manufactured, and operated according to one or more embodiments of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

The present disclosure aims to reduce the time and simplify the construction of in ground support structures, including without limitation support structures that are deployed within a body of reactive fluid, such as fresh water or salt water. In at least one embodiment, the principles of the present disclosure are particularly useful in reducing the time and simplifying the construction of over water bridges, such as sea bridges. The present disclosure, in at least one embodiment, employs expandable metal configured to expand in response to hydrolysis as a least a portion of one or more structural pillars of the support structure. Accordingly, the expandable metal may eliminate the aforementioned expenses associated with the pumping of the un-cured cement, as well as the expenses associated with the use of the cofferdams.

The term expandable metal, as used herein, refers to the expandable metal in a pre-expansion form (e.g., metal that has yet to expand in response to hydrolysis). Similarly, the term expanded metal, as used herein, refers to the resulting expanded metal after the expandable metal has been subjected to reactive fluid, as discussed below. The expanded metal, in accordance with one or more aspects of the disclosure, comprises a metal that has expanded in response to hydrolysis. In certain embodiments, the expanded metal includes residual unreacted metal. For example, in certain embodiments the expanded metal is intentionally designed to include the residual unreacted metal. The residual unreacted metal has the benefit of allowing the expanded metal to self-heal if cracks or other anomalies subsequently arise, for example is shifting of the soil were to occur. Nevertheless, other embodiments may exist wherein no residual unreacted metal exists in the expanded metal.

The expandable metal, in some embodiments, may be described as expanding to a cement like material. In other words, the expandable metal goes from metal to micron-scale particles and then these particles expand and lock together to, in essence, form a portion of the structural pillars. The reaction may, in certain embodiments, occur in less than 90 days in a reactive fluid, such as fresh water or salt water. In certain other embodiments, the reaction occurs in less than 30 days in a reactive fluid. Nevertheless, the time of reaction may vary depending on the reactive fluid, the expandable metal used, the temperature of the reactive fluid, and whether an external heat source or voltage source is applied to the expandable metal.

In some embodiments, the reactive fluid may be fresh water, such as may be found in an inshore lake. In other embodiments, the reactive fluid may be salt water, such as may be found in a sea or ocean. In other embodiments, the reactive fluid may be a combination of fresh water and salt water (e.g., brackish water), or may comprise any other known or hereafter discovered reactive fluid. The expandable metal is electrically conductive in certain embodiments. The expandable metal may be machined to any specific size/shape, extruded, formed, cast or other conventional ways to get the desired shape of a metal, as will be discussed in greater detail below. The expandable metal, in certain embodiments has a yield strength greater than about 8,000 psi, e.g., 8,000 psi +/−50%.

The hydrolysis of the expandable metal can create a metal hydroxide. The formative properties of alkaline earth metals (Mg—Magnesium, Ca—Calcium, etc.) and transition metals (Zn—Zinc, Al—Aluminum, etc.) under hydrolysis reactions demonstrate structural characteristics that are favorable for use with the present disclosure. Hydration results in an increase in size from the hydration reaction and results in a metal hydroxide that can precipitate from the fluid.

The hydration reactions for magnesium is:

$$Mg+2H_2O \rightarrow Mg(OH)_2+H_2,$$

where $Mg(OH)_2$ is also known as brucite. Another hydration reaction uses aluminum hydrolysis. The reaction forms a material known as Gibbsite, bayerite, and norstrandite, depending on form. The hydration reaction for aluminum is:

$$Al+3H_2O \rightarrow Al(OH)_3+3/2H_2.$$

Another hydration reaction uses calcium hydrolysis. The hydration reaction for calcium is:

$$Ca+2H_2O \rightarrow Ca(OH)_2+H_2,$$

Where $Ca(OH)_2$ is known as portlandite and is a common hydrolysis product of Portland cement. Magnesium hydroxide and calcium hydroxide are considered to be relatively insoluble in water. Aluminum hydroxide can be considered an amphoteric hydroxide, which has solubility in strong acids or in strong bases. Alkaline earth metals (e.g., Mg, CA, etc.) work well for the expandable metal, but transition metals (Al, etc.) also work well for the expandable metal. In one embodiment, the metal hydroxide is dehydrated by the swell pressure to form a metal oxide.

In an embodiment, the expandable metal used can be a metal alloy. The expandable metal alloy can be an alloy of the base expandable metal with other elements in order to either adjust the strength of the expandable metal alloy, to adjust the reaction time of the expandable metal alloy, or to adjust the strength of the resulting metal hydroxide byproduct, among other adjustments. The expandable metal alloy can be alloyed with elements that enhance the strength of the metal such as, but not limited to, Al—Aluminum, Zn—Zinc, Mn—Manganese, Zr—Zirconium, Y—Yttrium, Nd—Neodymium, Gd—Gadolinium, Ag—Silver, Ca—Calcium, Sn—Tin, and Re—Rhenium, Cu—Copper. In some embodiments, the expandable metal alloy can be alloyed with a dopant that promotes corrosion, such as Ni—Nickel, Fe—Iron, Cu—Copper, Co—Cobalt, Ir—Iridium, Au—Gold, C—Carbon, Ga—Gallium, In—Indium, Mg—Mercury, Bi—Bismuth, Sn—Tin, and Pd—Palladium. The expandable metal alloy can be constructed in a solid solution process where the elements are combined with molten metal or metal alloy. Alternatively, the expandable metal alloy could be constructed with a powder metallurgy process. The expandable metal can be cast, forged, extruded, sintered, welded, mill machined, lathe machined, stamped, eroded or a combination thereof.

Optionally, non-expanding components may be added to the starting metallic materials. For example, ceramic, elastomer, plastic, epoxy, glass, fibers, or non-reacting metal components can be embedded in the expandable metal or coated on the surface of the expandable metal. Alternatively, the starting expandable metal may be the metal oxide. For example, calcium oxide (CaO) with water will produce calcium hydroxide in an energetic reaction. Due to the higher density of calcium oxide, this can have a 260% volumetric expansion (e.g., converting 1 mole of CaO may cause the volume to increase from 9.5 cc to 34.4 cc). In one variation, the expandable metal is formed in a serpentinite reaction, a hydration and metamorphic reaction. In one variation, the resultant material resembles a mafic material. Additional ions can be added to the reaction, including silicate, sulfate, aluminate, carbonate, and phosphate. The metal can be alloyed to increase the reactivity or to control the formation of oxides.

The expandable metal can be configured in many different fashions, as long as an adequate volume of material is available for fully expanding. For example, the expandable metal may be formed into a single long member, multiple short members, and rings, among others. In certain other embodiments, the expandable metal is a collection of individual separate chunks of the metal held together with a binding agent. In yet other embodiments, the expandable metal is a collection of individual separate chunks of the metal that are not held together with a binding agent, but held together with a tubular or screen member. Additionally, a delay coating may be applied to one or more portions of the expandable metal to delay the expanding reactions.

Turning to FIG. 1, illustrated is a support structure 100 designed, manufactured and operated according to one or more embodiments of the disclosure. The support structure 100, in the illustrated embodiment, is positioned within the ground and at least partially within a body of reactive fluid. The body of reactive fluid, in at least one embodiment, may be any type of water, including fresh water, salt water and any combination thereof. In the illustrated embodiment of FIG. 1, the support structure 100 also extends into the air.

The support structure 100, in one aspect, includes one or more expanded metal structural pillars 110 positioned within the ground. In the embodiment of FIG. 1, the support structure 100 includes first, second and third expanded metal structural pillars 110*a*, 110*b*, 110*c*, but in many applications the support structure 100 will include tens, hundreds, or thousands of expanded metal structural pillars 110 while remaining within the scope of the disclosure. Each of the one or more expanded metal structural pillars 100 extends into the ground by a distance ($d_1$). The distance ($d_1$) may vary amongst the expanded metal structural pillars 100, and thus need not be the same.

Each of the expanded metal structural pillars 110, in accordance with the disclosure, may comprise a metal that has expanded in response to hydrolysis. In certain embodiments, an entirety of the expanded metal structural pillars 110 comprise the metal configured to expand in response to hydrolysis, as discussed above. In yet other embodiments, only a portion of the expanded metal structural pillars 110 comprise the metal that has expanded in response to hydrolysis.

The expanded metal structural pillars 110 illustrated in the embodiment of FIG. 1 each include a first pier portion 120 and a second column portion 125. In the illustrated embodiment of FIG. 1, the first pier portions 120 are located within the ground by the distance ($d_1$), and the second column portions extend over the ground by a distance ($d_2$). The distance ($d_2$) also need not be similar for all of the expanded metal structural pillars 110. The second column portions 125, in one or more embodiments, are located at least partially within the body of reactive fluid (e.g., water).

In at least one embodiment, the first pier portions 120 comprise the metal configured to expand in response to hydrolysis, while the second column portions 125 do not comprise a metal configured to expand in response to hydrolysis. In yet other embodiments, the first pier portions 120 do not comprise a metal configured to expand in response to hydrolysis, while the second column portion 125 do comprise a metal configured to expand in response to hydrolysis. In yet other embodiments, at least a portion of each of the first pier portions 120 and the second column portions 125 comprise the metal configured to expand in response to hydrolysis.

The expandable metal structural pillars, in one or more embodiments, have a volume of at least 0.2 $m^3$. The expandable metal structural pillars, in one or more alternative embodiments, have a volume of at least 1 $m^3$. The expandable metal structural pillars, in yet one or more other embodiments, have a volume of at least 5 $m^3$. The resulting expanded metal structural pillars 110, in one or more embodiments, have a volume of at least 0.36 $m^3$. The expanded metal structural pillars 110, in one or more alternative embodiments, have a volume of at least 1.8 $m^3$. The expanded metal structural pillars 110, in yet one or more other embodiments, have a volume of at least 9 $m^3$. Nevertheless, the volume of the expandable metal structural pillars and resulting expanded metal structural pillars 110 may vary greatly and remain within the scope of the disclosure.

In one or more embodiments, headstocks 130 may be coupled to upper ends of the column portions 125. For example, in the embodiment of FIG. 1, a first headstock 130*a* is coupled to an upper end of the first column portion 125*a*, a second headstock 130*b* is coupled to an upper end of the second column portion 125*b*, and a third headstock 130*c* is coupled to an upper end of the third column portion 125*c*. Further to the embodiment of FIG. 1, one or more beams 140 may be coupled to the headstocks 130 and spanning the expanded metal structural pillars 110.

Figure 2:
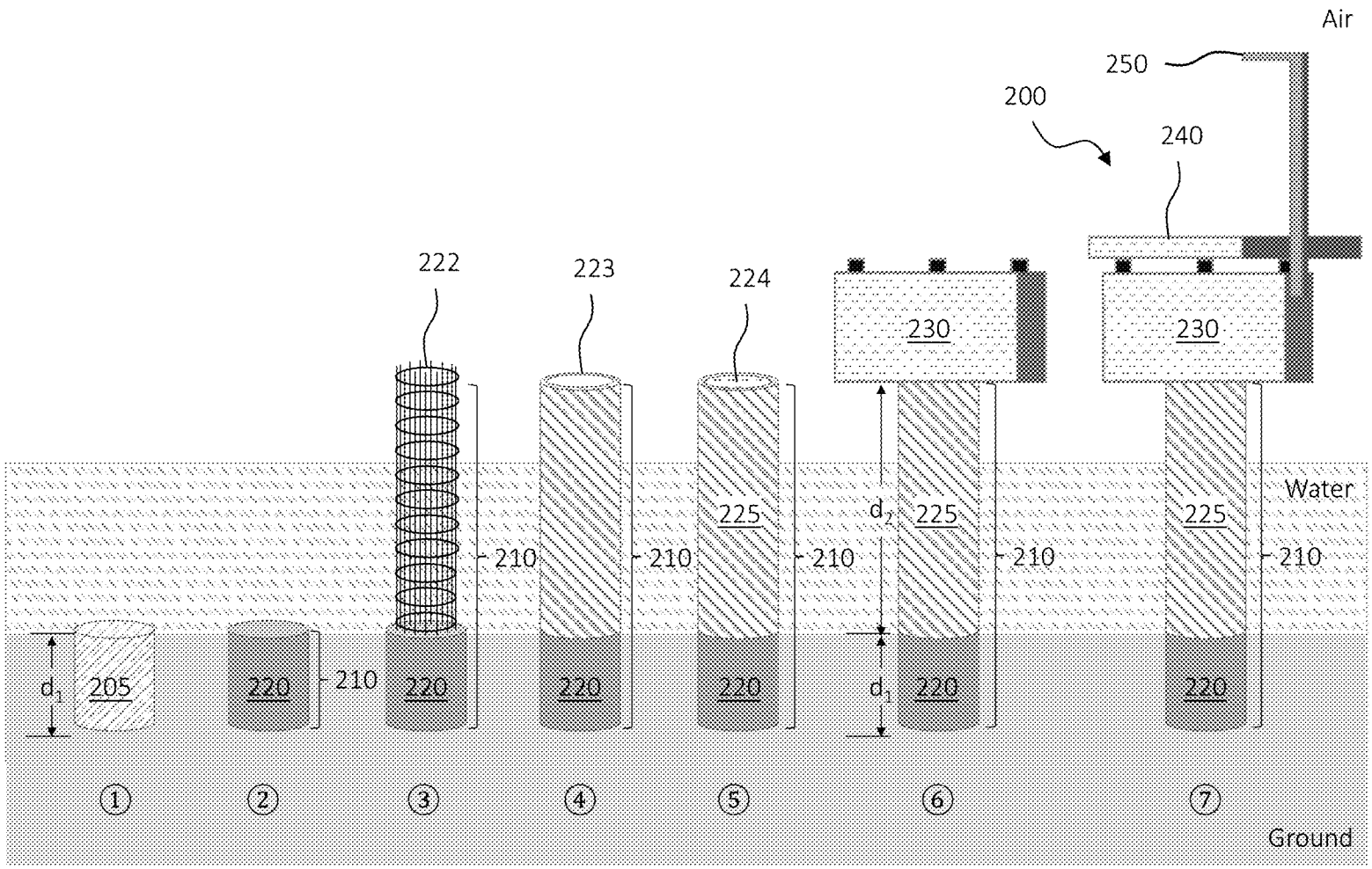
FIG. 2 depicts one method for forming a support structure in accordance with one or more embodiments of the disclosure.

Turning to FIG. 2, illustrated is one method for forming a support structure 200 in accordance with one or more embodiments of the disclosure. The method of FIG. 2 may begin by placing one or more expandable metal structural pillars 205 into ground by a distance ($d_1$). Traditionally, the one or more expandable metal structural pillars 205 are offset from one another. In accordance with the disclosure, at least a portion of the one or more expandable metal structural pillars 205 comprises a metal configured to expand in response to hydrolysis, as discussed in detail above.

The one or more expandable metal structural pillars 205 may be positioned in the ground using a variety of different methods. In one embodiment, one or more holes are dug or drilled within the ground, and then the one or more expandable metal structural pillars 205 are positioned within the holes. In another embodiment, the one or more expandable metal structural pillars 205 are pressed or driven within the ground. In yet another embodiment, the one or more expandable metal structural pillars 205 include a fluid passageway extending there through, and fluid (e.g., high pressure fluid) is supplied through the fluid passageways while the expandable metal structural pillars 205 are being pressed into the ground. In this embodiment, the fluid forms an opening in the ground for the expandable metal structural pillars 205, and thus helps the process of pressing the expandable metal structural pillars 205 within the ground.

The distance ($d_1$) may vary greatly and remain within the scope of the disclosure. For instance, the distance ($d_1$) may vary greatly based upon soil type, the intended weight of the support structure 200, the weight of the intended contents passing over the support structure 200, and the life expectancy of the support structure 200, among other factors. In at least one embodiment, the distance ($d_1$) is at least 3 meters. In another embodiment, the distance ($d_1$) is as least 10 meters. In yet another embodiment, the distance ($d_1$) is at least 15 meters, at least 20 meters, or even at least 25 meters or more. Nevertheless, the present disclosure is not limited to any specific distance ($d_1$).

The one or more expandable metal structural pillars 205 are illustrated in FIG. 2 as stopping at or near the surface of the ground, and thus only forming a pier portion. As will be discussed in greater detail below, the one or more expandable metal structural pillars 205 may extend above the ground, and thus into the water, and thereby form a pier portion within the ground and a column portion within the water. In yet another embodiment, the one or more expandable metal structural pillars 205 extend above the water, and thus into the air, and thereby form a pier portion within the ground and a column portion within the water and air. It should be understood, however, the expandable metal typically requires at least some resistance to stop the hydrolysis reaction, and thus prevent the expandable metal from entirely disintegrating. The ground provides the necessary resistance for those portions of the one or more expandable metal structural pillars 205 located therein. However, for those portions of the expandable metal structural pillars 205 located above the ground, a tubular, regardless of material (e.g., steel, metal, concrete, composite, etc.) and construction (e.g., solid, slotted, meshed, etc.) is desirable, if not required, to provide the necessary resistance.

In a second step, the one or more expandable metal structural pillars 205 are allowed to be exposed to reactive fluid, in this embodiment water (e.g., salt water). What results are one or more expanded metal structural pillars 210 located at least partially within the ground. Again, in the embodiment of FIG. 2, the expanded metal structural pillars 210 at this stage are only the first pier portions 220. The details for the hydrolysis reaction, and the resulting expanded metal structural pillars 210 are discussed above.

In a third step, one or more reinforcement structures 222 may be positioned on the first pier portions 220 of the expanded metal structural pillars 210. The one or more reinforcement structures 222, in one or more embodiments, are one or more cylindrical reinforcement cages. The cylindrical reinforcement cages may comprise steel, among other reinforcement materials.

In a fourth step, one or more tubulars 223 may be positioned around the one or more reinforcement structures 222. The one or more tubulars 223 may again comprise many different materials and remain within the scope of the disclosure. In the embodiment shown, however, the one or more tubulars 223 comprise steel. The one or more tubulars 223, in the disclosed embodiment, isolate the interior of the one or more tubulars from the surrounding water, as well as provide a mold for un-cured concrete to be poured.

In a fifth step, un-cured concrete 224 may be poured within opening in the tubulars 223. In one embodiment, the water may be pumped from the openings in the tubulars 223 prior to pouring the un-cured concrete 224. In yet another embodiment, the un-cured concrete 224 is poured within the one or more tubulars 223, which in turn displaces the water. Accordingly, it is not always necessary to pump the water from the opening in the tubulars 223 prior to pouring the un-cured concrete 224. What results, after curing, are a plurality of expanded metal structural pillars 210.

In a sixth step, one or more headstocks 230 may be delivered to site and installed on top of each of the one or more expanded metal structural pillars 210. The one or more headstocks 230, in at least one embodiment, are pre-cast headstocks. The one or more headstocks 230, in the illustrated embodiment, are coupled to an upper end of the column portions 225. The one or more headstocks 230, in at least one embodiment, support the support structure 200 spans and transfer the support structure 220 load to the expanded metal structural pillars 210 there below.

In a seventh step, one or more beams 240 may be placed along and spanning the one or more headstocks 230. The one or more beams 240 may comprise a variety of different structures and remain within the scope of the present disclosure. For example, in at least one embodiment, the beams 240 may be one or more large conduits (e.g., fluid conduits) spanning the one or more headstocks 230. In another embodiment, the one or more beams 240 may be a base for a transportation path, such as a road for automobiles (e.g., motorcycles, cars, trucks, semis, etc.) or train tracks for a train, etc. The support structure 200 may additionally include signaling, communications, and power, as shown with feature 250.

Figure 3C:
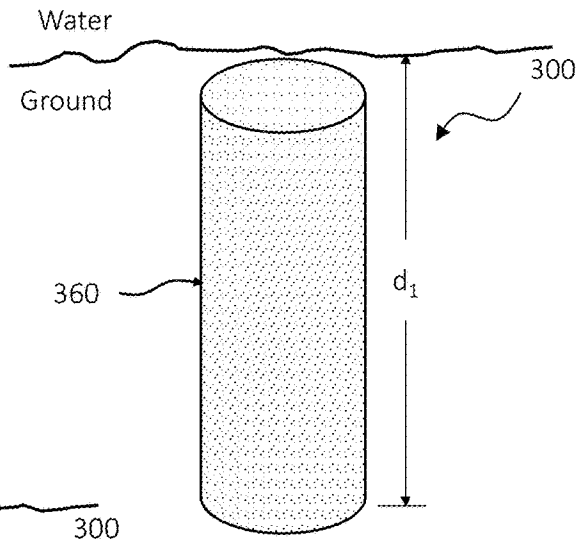
FIGS. 3A through 3C depict various different manufacturing states for a structural pillar designed, manufactured, and operated according to one example embodiment of the disclosure.
Figure 3B:
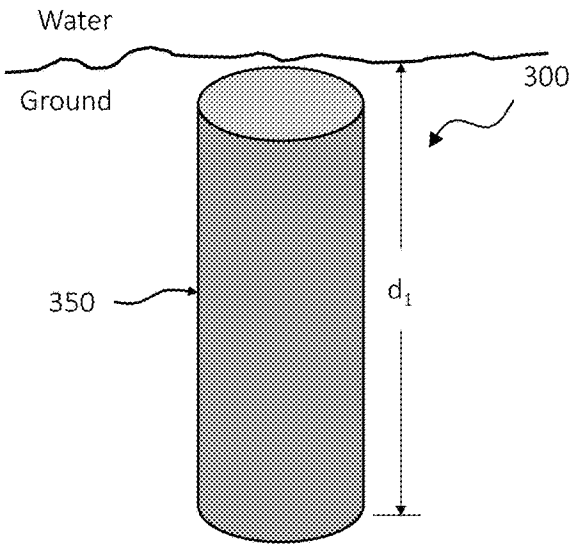
Figure 3A:
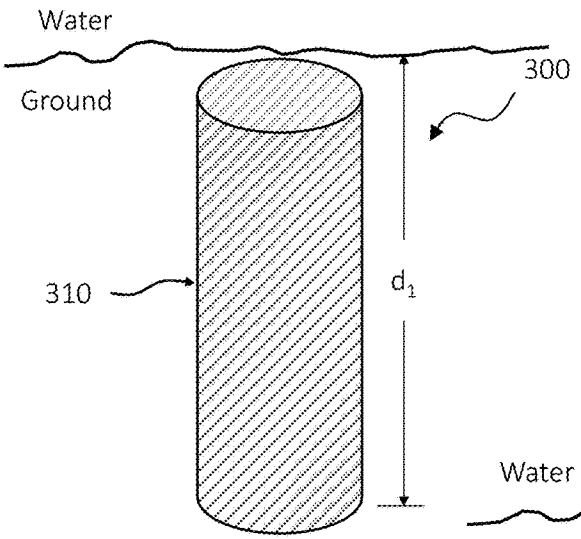

Turning to FIGS. 3A through 3C, depicted are various different manufacturing states for a structural pillar 300 designed, manufactured, and operated according to one example embodiment of the disclosure. FIG. 3A illustrates the structural pillar 300 pre-expansion, FIG. 3B illustrates the structural pillar 300 post-expansion, and FIG. 3C illustrates the structural pillar 300 post-expansion and containing residual unreacted expandable metal therein. With reference to FIG. 3A, the structural pillar 300 is an expandable metal structural pillar 310. The expandable metal structural pillar 310, in accordance with one or more embodiments of the disclosure, comprises a metal configured to expand in response to hydrolysis. The expandable metal structural pillar 310, in the illustrated embodiment, may comprise any of the expandable metals discussed above, or any combination of the same.

In the embodiment of FIG. 3A, the expandable metal structural pillar 310 comprises a solid member of expandable metal. The solid member of expandable metal may have a variety of different shapes and remain within the scope of the disclosure. In at least one embodiment, as is shown, the solid member of expandable metal has a circular cross-section. In other embodiments, non-circular cross-sections may be used. Further to the embodiment of FIG. 3A, the expandable metal structural pillar 310 extends into the ground by a distance ($d_1$), which may vary as discussed above.

With reference to FIG. 3B, illustrated is the expandable metal structural pillar 310 illustrated in FIG. 3A after having been subjecting to reactive fluid (e.g., the water) to expand the metal, and thereby form an expanded metal structural pillar 350. Accordingly, the expanded metal structural pillar 350 comprises a metal that has expanded in response to hydrolysis. In the illustrated embodiment, the expanded metal structural pillar 350 generally fills any voids within the ground, and thereby forms a sturdy structural pillar for building upon.

With reference to FIG. 3C, illustrated is the expandable metal structural pillar 310 illustrated in FIG. 3A after having been subjecting to reactive fluid (e.g., the water) to expand the metal, and thereby form an expanded metal structural pillar including residual unreacted expandable metal 360. Accordingly, the expanded metal structural pillar including residual unreacted expandable metal 360 comprises a metal that has expanded in response to hydrolysis. In one embodiment, the expanded metal structural pillar including residual unreacted expandable metal 360 includes at least 1% residual unreacted expandable metal therein. In yet another embodiment, the expanded metal structural pillar including residual unreacted expandable metal 360 includes at least 3% residual unreacted expandable metal therein. In even yet another embodiment, the expanded metal structural pillar including residual unreacted expandable metal 360 includes at least 10% residual unreacted expandable metal therein, and in certain embodiments at least 20% residual unreacted expandable metal therein.

Turning now to FIGS. 4A through 4C, depicted are various different manufacturing states for a structural pillar 400 designed, manufactured and operated according to an alternative embodiment of the disclosure. FIG. 4A illustrates the structural pillar 400 pre-expansion, FIG. 4B illustrates the structural pillar 400 post-expansion, and FIG. 4C illustrates the structural pillar 400 post-expansion and containing residual unreacted expandable metal therein. The structural pillar 400 of FIGS. 4A through 4C is similar in many respects to the structural pillar 300 of FIGS. 3A through 3C. Accordingly, like reference numbers have been used to illustrate similar, if not identical, features. The structural pillar 400 differs, for the most part, from the structural pillar 300, in that the expandable metal structural pillar 310 includes a fluid passageway 410 extending through a length thereof. In at least one embodiment, the fluid passageway 410 is substantially centered about a centerline of the expandable metal structural pillar 310. The fluid passageway 410 may be used to provide high pressure fluid to a bottom end of the expandable metal structural pillar 310 during the installation thereof. In certain embodiments, such as shown, the fluid passageway 410 will close when the expandable metal structural pillar 310 is subjected to the reactive fluid. Accordingly, the expanded metal structural pillar 350 of FIGS. 4B and 4C does not include the fluid passageway 410.

Figure 5C:
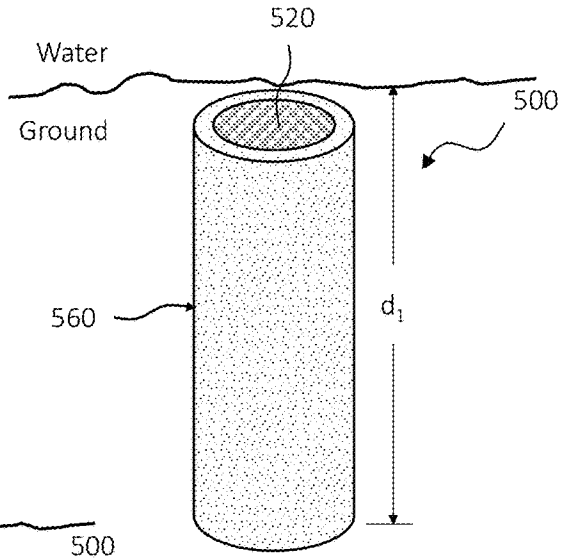
FIGS. 5A through 5C depict various different manufacturing states for a structural pillar designed, manufactured, and operated according to an alternative embodiment of the disclosure.
Figure 5B:
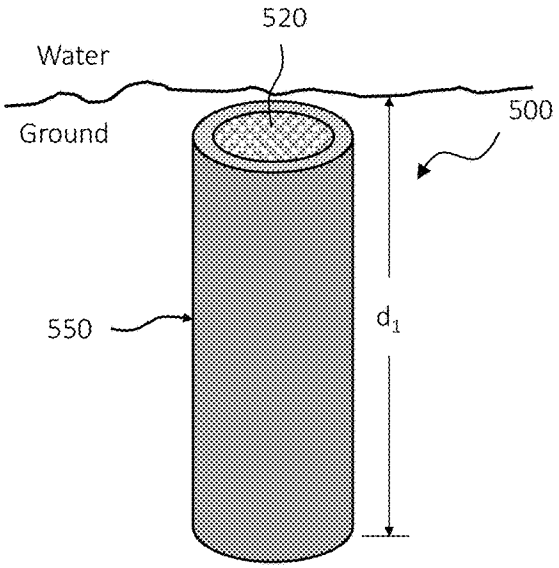
Figure 5A:
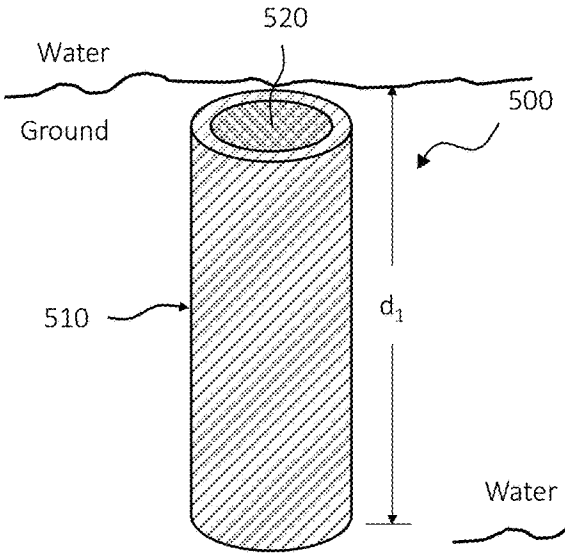

Turning now to FIGS. 5A through 5C, depicted are various different manufacturing states for a structural pillar 500 designed, manufactured and operated according to an alternative embodiment of the disclosure. FIG. 5A illustrates the structural pillar 500 pre-expansion, FIG. 5B illustrates the structural pillar 500 post-expansion, and FIG. 5C illustrates the structural pillar 500 post-expansion and containing residual unreacted expandable metal therein. The structural pillar 500 of FIGS. 5A through 5C is similar in many respects to the structural pillar 300 of FIGS. 3A through 3C. Accordingly, like reference numbers have been used to illustrate similar, if not identical, features. The structural pillar 500 differs, for the most part, from the structural pillar 300, in that the structural pillar 500 includes an expandable metal tubular 510 having concrete 520 located in a hollow portion thereof, as shown in FIG. 5A. What results is an expanded metal tubular 550 having concrete 520 located therein, as is shown in FIG. 5B, or an expanded metal tubular including residual unreacted expandable metal 560 having concrete 520 located therein, as shown in FIG. 5C.

Figure 6C:
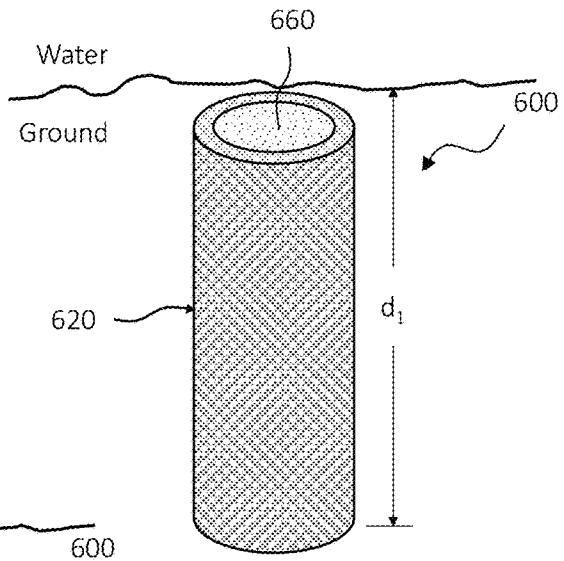
FIGS. 6A through 6C depict various different manufacturing states for a structural pillar designed, manufactured, and operated according to an alternative embodiment of the disclosure.
Figure 6B:
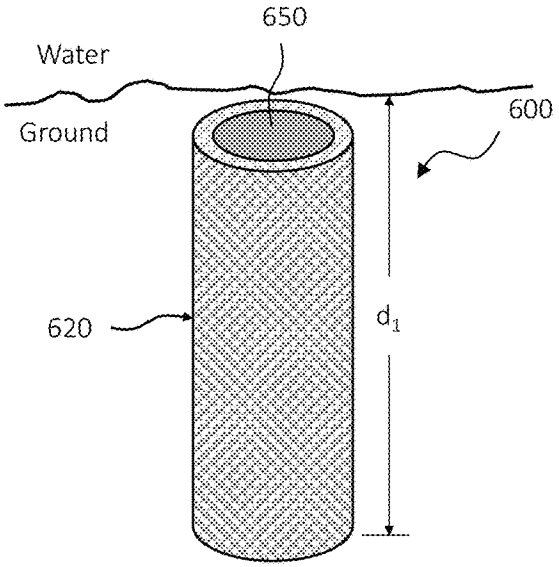
Figure 6A:
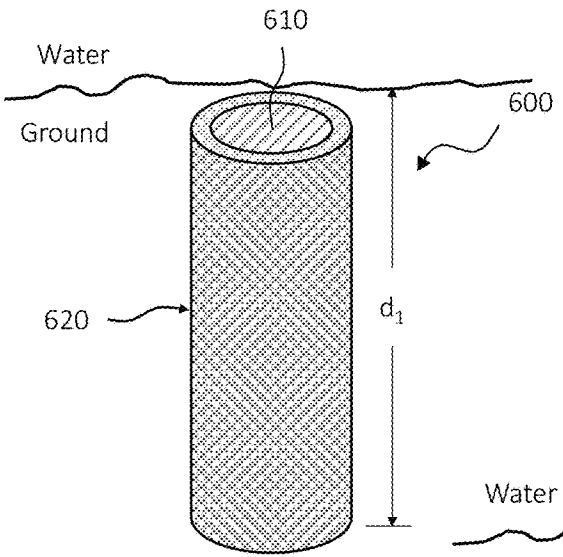

Turning now to FIGS. 6A through 6C, depicted are various different manufacturing states for a structural pillar 600 designed, manufactured and operated according to an alternative embodiment of the disclosure. FIG. 6A illustrates the structural pillar 600 pre-expansion, FIG. 6B illustrates the structural pillar 600 post-expansion, and FIG. 6C illustrates the structural pillar 600 post-expansion and containing residual unreacted expandable metal therein. The structural pillar 600 of FIGS. 6A through 6C is similar in many respects to the structural pillar 300 of FIGS. 3A through 3C. Accordingly, like reference numbers have been used to illustrate similar, if not identical, features. The structural pillar 600 differs, for the most part, from the structural pillar 300, in that the structural pillar 600 includes a concrete tubular 620 having expandable metal 610 located in a hollow portion thereof, as shown in FIG. 6A. What results is a concrete tubular 620 having expanded metal 650 located in a hollow portion thereof, as is shown in FIG. 6B, or a concrete tubular 620 having residual unreacted expandable metal 660 located in a hollow portion thereof, as shown in FIG. 6C.

Figure 7C:
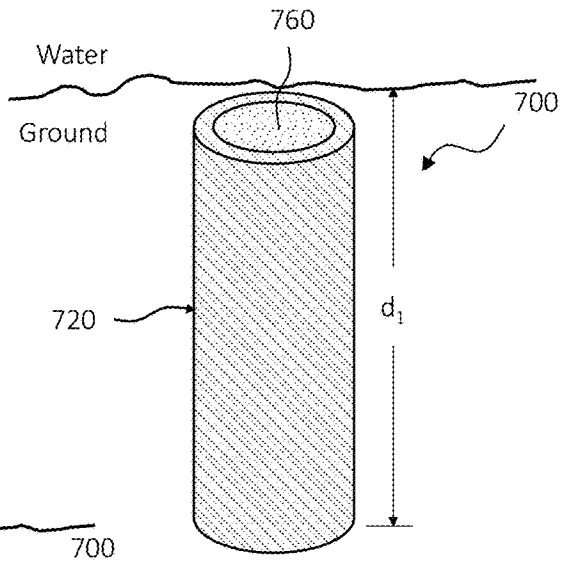
FIGS. 7A through 7C depict various different manufacturing states for a structural pillar designed, manufactured, and operated according to an alternative embodiment of the disclosure.
Figure 7B:
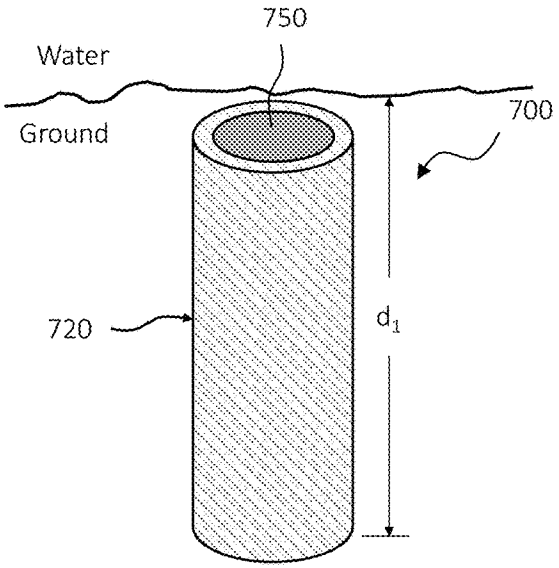
Figure 7A:
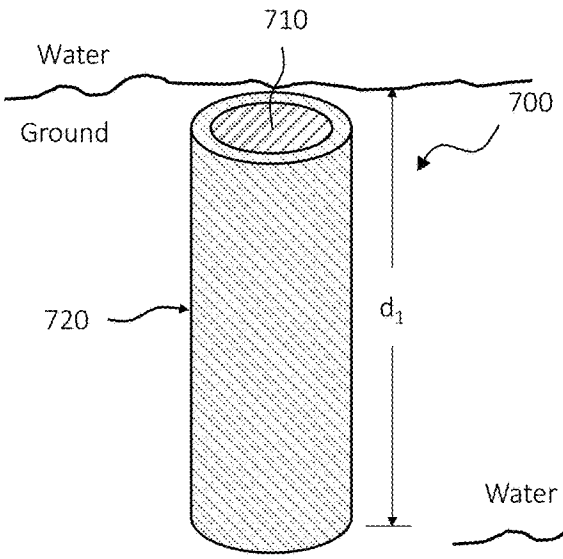

Turning now to FIGS. 7A through 7C, depicted are various different manufacturing states for a structural pillar 700 designed, manufactured and operated according to an alternative embodiment of the disclosure. FIG. 7A illustrates the structural pillar 700 pre-expansion, FIG. 7B illustrates the structural pillar 700 post-expansion, and FIG. 7C illustrates the structural pillar 700 post-expansion and containing residual unreacted expandable metal therein. The structural pillar 700 of FIGS. 7A through 7C is similar in many respects to the structural pillar 300 of FIGS. 3A through 3C. Accordingly, like reference numbers have been used to illustrate similar, if not identical, features. The structural pillar 700 differs, for the most part, from the structural pillar 300, in that the structural pillar 700 includes a metal tubular 720 having expandable metal 710 located in a hollow portion thereof, as shown in FIG. 7A. The metal tubular 720, in at least this embodiment, is not configured to expand in response to hydrolysis. What results is a metal tubular 720 having expanded metal 750 located in a hollow portion thereof, as is shown in FIG. 7B, or a metal tubular 720 having residual unreacted expandable metal 760 located in a hollow portion thereof, as shown in FIG. 7C. In at least one or more embodiments, rather than the metal tubular 720, a composite tubular could be used.

Figures 8A, 8B, 8C:
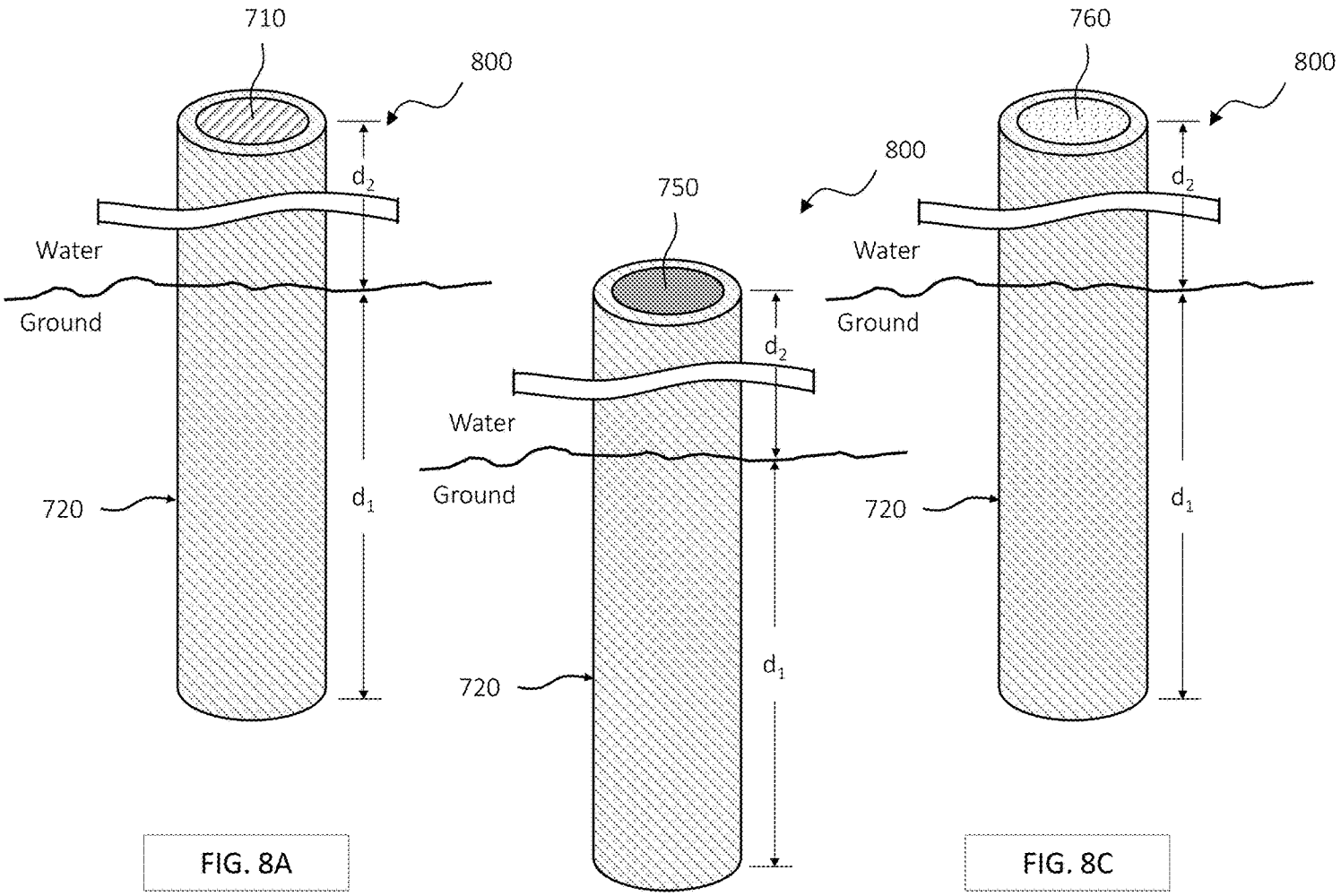
FIGS. 8A through 8C depict various different manufacturing states for a structural pillar designed, manufactured, and operated according to an alternative embodiment of the disclosure.

Turning now to FIGS. 8A through 8C, depicted are various different manufacturing states for a structural pillar 800 designed, manufactured and operated according to an alternative embodiment of the disclosure. FIG. 8A illustrates the structural pillar 800 pre-expansion, FIG. 8B illustrates the structural pillar 800 post-expansion, and FIG. 8C illustrates the structural pillar 800 post-expansion and containing residual unreacted expandable metal therein. The structural pillar 800 of FIGS. 8A through 8C is similar in many respects to the structural pillar 700 of FIGS. 7A through 7C. Accordingly, like reference numbers have been used to illustrate similar, if not identical, features. The structural pillar 800 differs, for the most part, from the structural pillar 700, in that the structural pillar 800 extends over the ground by a distance ($d_2$).

Turning now to FIGS. 9A through 9C, depicted are various different manufacturing states for a structural pillar 900 designed, manufactured and operated according to an alternative embodiment of the disclosure. FIG. 9A illustrates the structural pillar 900 pre-expansion, FIG. 9B illustrates the structural pillar 900 post-expansion, and FIG. 9C illustrates the structural pillar 900 post-expansion and containing residual unreacted expandable metal therein. The structural pillar 900 of FIGS. 9A through 9C is similar in many respects to the structural pillar 300 of FIGS. 3A through 3C. Accordingly, like reference numbers have been used to illustrate similar, if not identical, features. The structural pillar 900 differs, for the most part, from the structural pillar 300, in that the structural pillar 900 includes one or more reinforcement members 920 positioned therein. In at least one embodiment, the one or more reinforcement members 920 are one or more metal reinforcement members. In at least one other embodiment, the one or more reinforcement members 920 are one or more metal reinforcement rods that extend along a length (l) thereof.

Figure 10C:
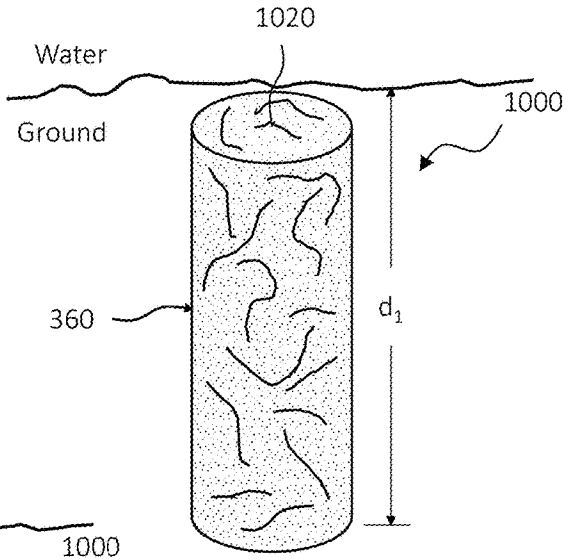
FIGS. 10A through 10C depict various different manufacturing states for a structural pillar designed, manufactured, and operated according to an alternative embodiment of the disclosure.
Figure 10B:
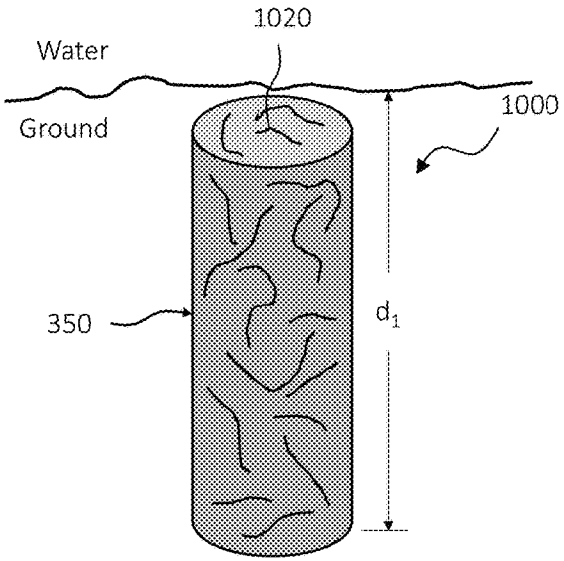
Figure 10A:
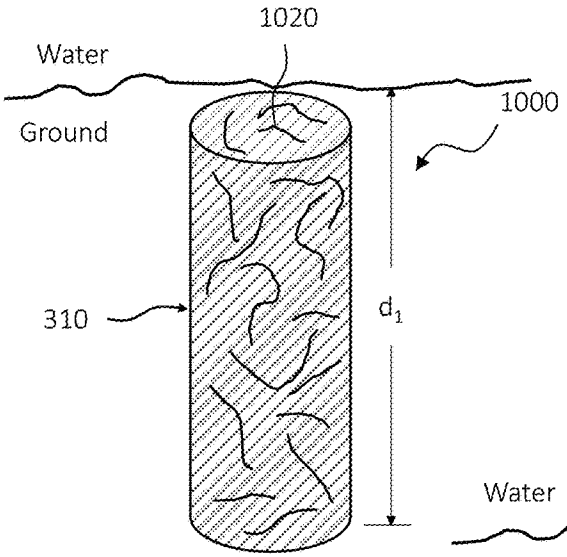

Turning now to FIGS. 10A through 10C, depicted are various different manufacturing states for a structural pillar 1000 designed, manufactured, and operated according to an alternative embodiment of the disclosure. FIG. 10A illustrates the structural pillar 1000 pre-expansion, FIG. 10B illustrates the structural pillar 1000 post-expansion, and FIG. 10C illustrates the structural pillar 1000 post-expansion and containing residual unreacted expandable metal therein. The structural pillar 1000 of FIGS. 10A through 10C is similar in many respects to the structural pillar 300 of FIGS. 3A through 3C. Accordingly, like reference numbers have been used to illustrate similar, if not identical, features. The structural pillar 1000 differs, for the most part, from the structural pillar 300, in that the structural pillar 1000 includes non-expanding strengthening particulates 1020 dispersed therein. In at least one embodiment, the non-expanding strengthening particulates 1020 are randomly dispersed therein. The non-expanding strengthening particulates 1020 may comprise many different materials and shapes and remain within the scope of the disclosure. In at least one embodiment, however, the non-expanding strengthening particulates 1020 include pieces of steel, pieces of composite or fibers.

Figure 11B:
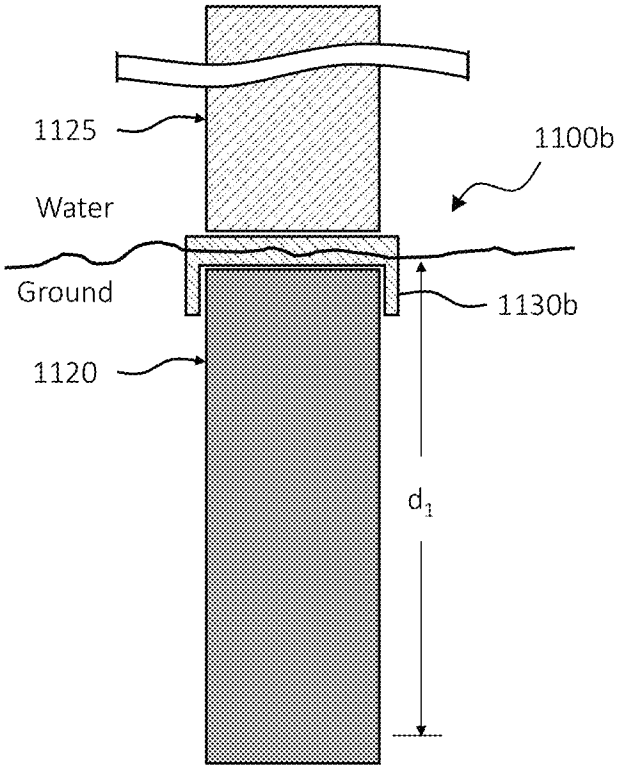
FIGS. 11A through 11B depict various different manufacturing states for a structural pillar designed, manufactured, and operated according to an alternative embodiment of the disclosure.
Figure 11A:
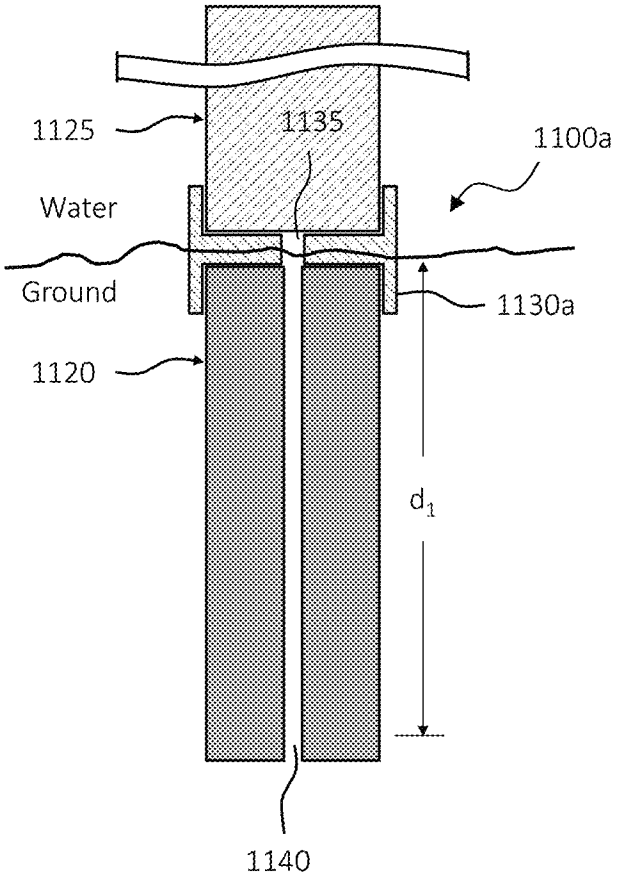

Turning now to FIG. 11A, depicted is an expanded metal structural pillar 1100*a* designed, manufactured, and operated according to an alternative embodiment of the disclosure. The expanded metal structural pillar 1100*a* includes an expanded metal pier portion 1120 positioned within the ground, and a column portion 1125 extending over the ground. The column portion 1125, in one or more embodiments, does not comprise a metal configured to expand in response to hydrolysis. In other embodiments, the column portion 1125 does comprise a metal configured to expand in response to hydrolysis.

In the embodiment of FIG. 11A, an adapter plate 1130*a* is positioned between the pier portion 1120 and the column portion 1125. In at least one embodiment, the adapter plate 1130*a* is configured to keep the pier portion 1120 and the column portion 1125 aligned. The adapter plate 1130*a*, in the illustrated embodiment, is an I-beam type adapter plate. Furthermore, in at least one embodiment, the adapter plate 1130*a* includes an opening 1135 therein, for example to fluidly couple with a fluid passageway 1140 in the pier portion 1120. As indicated above, and as will be discussed below, the opening 1135 and the fluid passageway 1140 may be used to assist in the setting of the pier portion 1120.

Turning now to FIG. 11B, depicted is an expanded metal structural pillar 1100*b* designed, manufactured, and operated according to an alternative embodiment of the disclosure. The structural pillar 1100*b* of FIG. 11B is similar in many respects to the structural pillar 1100*a* of FIG. 11A. Accordingly, like reference numbers have been used to illustrate similar, if not identical, features. The structural pillar 1100*b* differs, for the most part, from the structural pillar 1100*a*, in that the adapter plate 1130*b* of the structural pillar 1100*b* does not include an opening, and furthermore is shaped as a U-beam. Additionally, the pier portion 1120 does not include the fluid passageway.

Figure 12:
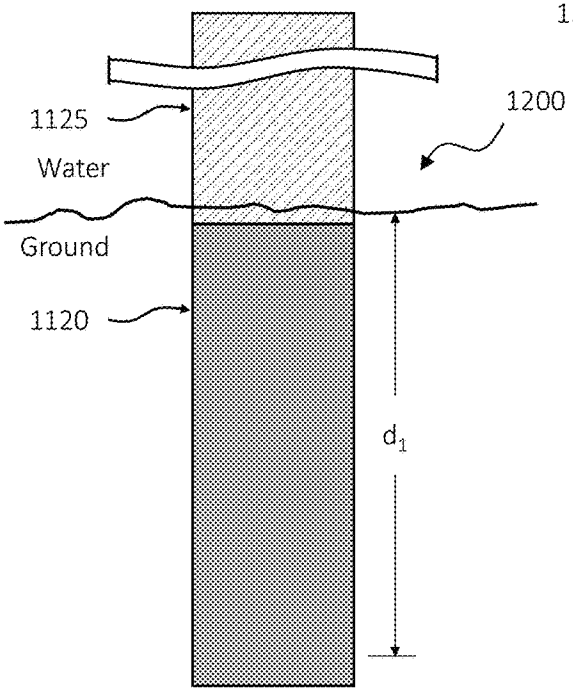
FIG. 12 depicts an expanded metal structural pillar designed, manufactured, and operated according to an alternative embodiment of the disclosure.

Turning now to FIG. 12, depicted is an expanded metal structural pillar 1200 designed, manufactured, and operated according to an alternative embodiment of the disclosure. The structural pillar 1200 of FIG. 12 is similar in many respects to the structural pillar 1100*a* of FIG. 11A. Accordingly, like reference numbers have been used to illustrate similar, if not identical, features. The structural pillar 1200 differs, for the most part, from the structural pillar 1100*a*, in that the structural pillar 1200 does not employ an adapter plate. Accordingly, the column portion 1125 rests direction on the pier portion 1120.

Figure 13A:
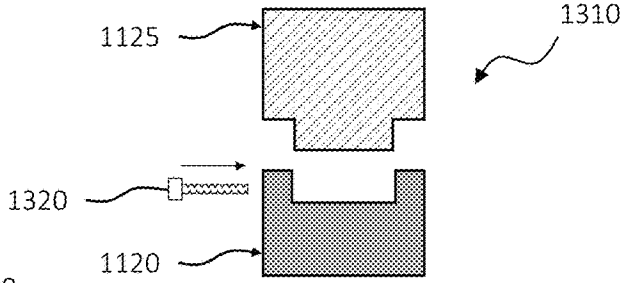
FIGS. 13A through 13C depict certain locking mechanisms that may be used for the structural pillar illustrated in FIG. 12.
Figure 13B:
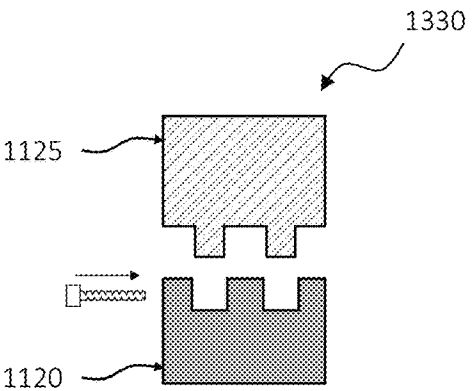
Figure 13C:
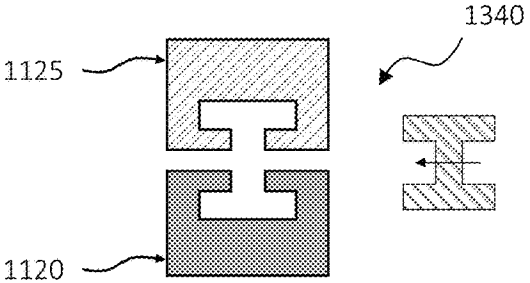

Turning now to FIGS. 13A through 13C, illustrated are certain locking mechanisms that may be used for the structural pillar 1200 illustrated in FIG. 12. FIG. 13A illustrates a single tongue and groove locking mechanism 1310 that might be used to couple the column portion 1125 to the pier portion 1120. In at least one embodiment, a fastener 1320 could be used to keep the column portion 1125 coupled to the pier portion. FIG. 13B illustrates a multi tongue and groove locking mechanism 1330 that might be used to couple the column portion 1125 to the pier portion 1120. FIG. 13C illustrates a self-locking mechanism 1340 that might be used to couple the column portion 1125 to the pier portion 1120. In the embodiment of FIG. 13C, the self-locking mechanism 1340 is a castle shape, but other shapes are within the scope of the disclosure.

Figure 14:
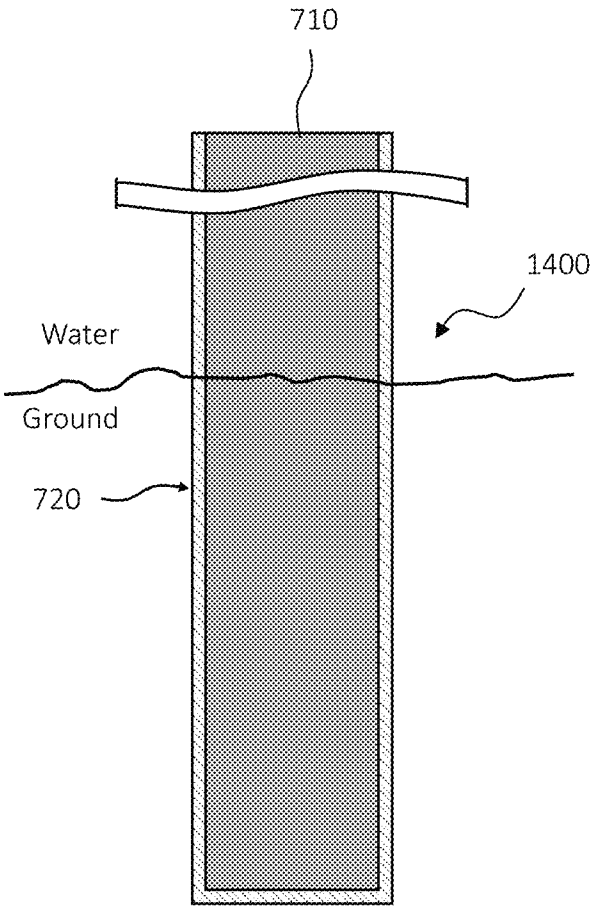
FIG. 14 depicts an expanded metal structural pillar designed, manufactured, and operated according to an alternative embodiment of the disclosure.

Turning now to FIG. 14, depicted is an expanded metal structural pillar 1400 designed, manufactured, and operated according to an alternative embodiment of the disclosure. The structural pillar 1400 of FIG. 14 is similar in many respects to the structural pillar 700 of FIGS. 7A through 7C. Accordingly, like reference numbers have been used to illustrate similar, if not identical, features. The structural pillar 1400 differs, for the most part, from the structural pillar 700, in that the structural pillar 1400 extends about the water level. Accordingly, the pier portion and the column portion are one and the same.

Turning now to FIGS. 15A through 15D, illustrated is one embodiment of a method for deploying a structural pillar 1500 in accordance with the disclosure. The structural pillar 1500 is similar in many respects to the structural pillar 1100*a* in FIG. 11A. Accordingly, like reference numbers have been used to illustrate similar, if not identical, features. The process begins in FIG. 15A by coupling a fluid source 1550 to the opening 1135 in the adapter plate 1130*a*. Accordingly, the fluid source 1550 is capable of providing fluid through the opening 1135 to the fluid passageway 1530 in the expandable metal structural pillar 1520.

Figure 15B:
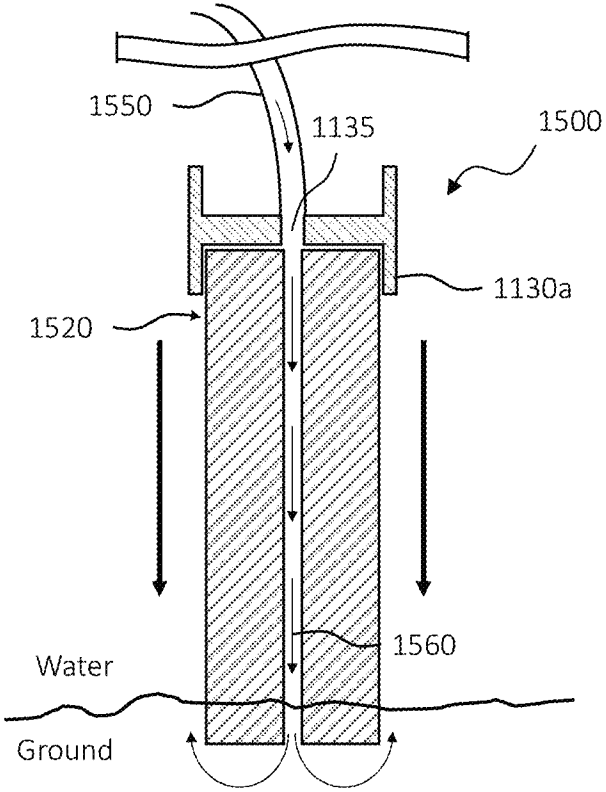
FIGS. 15A through 15E depict one embodiment of a method for deploying a structural pillar 1500 in accordance with the disclosure.
Figure 15A:
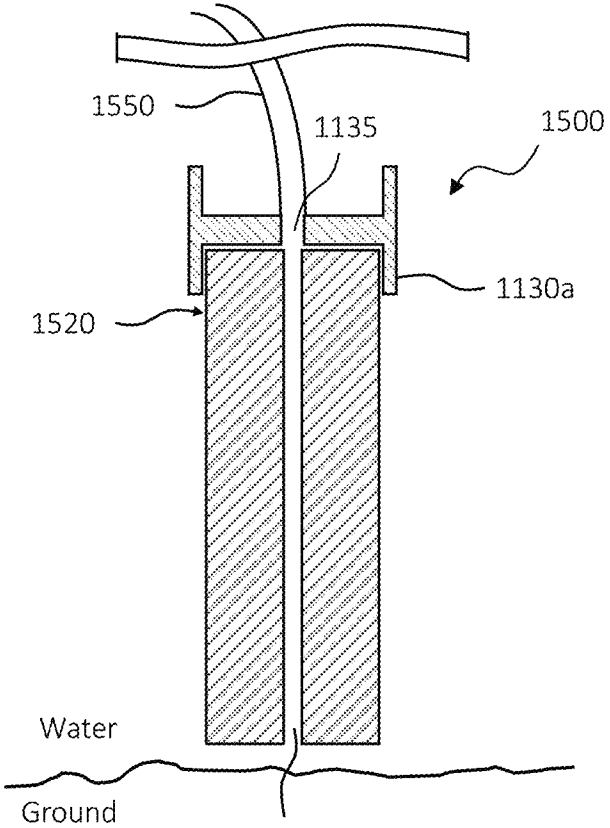
Figure 15D:
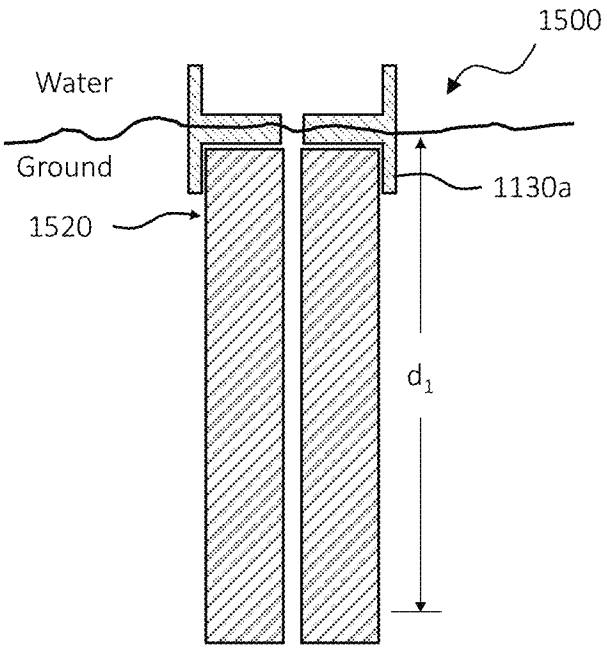
Figure 15C:
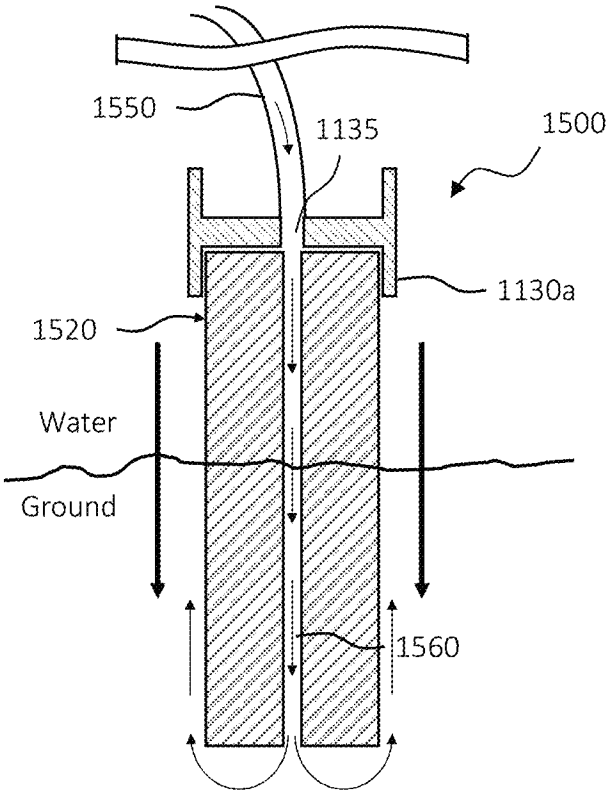
Figure 15E:
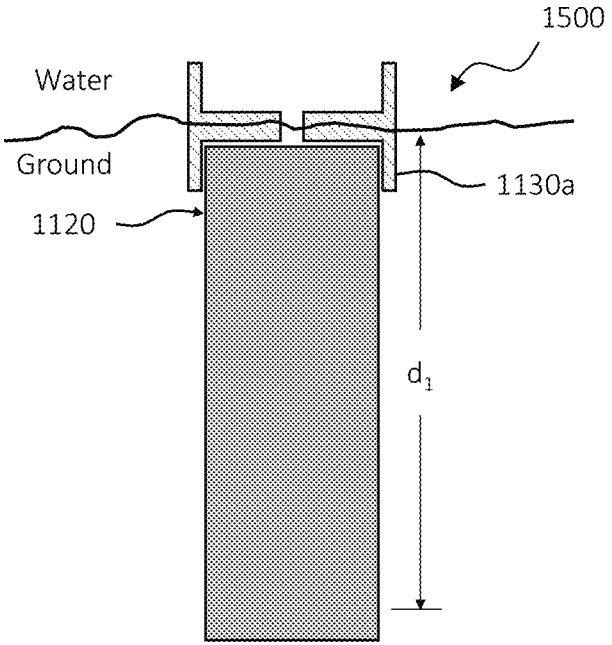

As shown in FIG. 15B, the expandable metal structural pillar 1520 is being pressed within the ground while fluid 1560 is being supplied through the fluid passageway 1530, the fluid 1560 forming an opening in the ground for the first expandable metal structural pillar 1520 to be pressed within. FIG. 15C illustrates the expandable metal structural pillar 1520 being further pressed within the ground while the fluid 1560 is being supplied through the fluid passageway 1530. FIG. 15D illustrates the expandable metal structural pillar 1520 fully contained within the ground, and the fluid source 1550 having been removed. FIG. 15E illustrates the expandable metal structural pillar having undergone hydrolysis, thus resulting in an expanded metal structural pillar 1120 within the ground.

Aspects disclosed herein include:

A. A support structure, the support structure including: 1) first and second expanded metal structural pillars positioned within the ground by a distance ($d_1$), the first and second expanded metal structural pillars comprising a metal that has expanded in response to hydrolysis; and 2) one or more beams spanning the first and second expanded metal structural pillars.

B. A method for forming a support structure, the method including: 1) placing first and second expandable metal structural pillars into ground by a distance ($d_1$), the first and second expandable metal structural pillars offset from one another, wherein at least a portion of the first and second expandable metal structural pillars comprises a metal configured to expand in response to hydrolysis; and 2) allowing the first and second expandable structural pillar to be exposed to reactive fluid to form first and second expanded metal structural pillars located at least partially within the ground.

Aspects A, B, and C may have one or more of the following additional elements in combination: Element 1: wherein each of the first and second expanded metal structural pillars includes a first pier portion located within the ground by the distance ($d_1$), and a second column portion extending over the ground by a distance ($d_2$). Element 2: wherein the second column portion of each of the first and second expanded metal structural pillars is located at least partially within a body of water. Element 3: further including an adapter plate positioned between at least one first pier portion and at least one second column portion, the adapter plate configured to keep the at least one first pier portion and the at least one second column portion aligned. Element 4: further including a first headstock coupled to an upper end of the first column portion, and a second headstock coupled to an upper end of the second column portion, the one or more beams coupled to the first and second headstocks and spanning the first and second expanded metal structural pillars. Element 5: wherein the first and second expanded metal structural pillars include one or more metal reinforcement members positioned therein. Element 6: wherein the one or more metal reinforcement members are one or more reinforcement rods extend along a length (l) thereof. Element 7: wherein the first and second expanded metal structural pillars include non-expanding strengthening particulates randomly dispersed therein. Element 8: wherein the non-expanding strengthening particulates include pieces of steel, pieces of composite or fibers. Element 9: wherein the first and second expanded metal structural pillars are first and second expanded metal tubulars having concrete located in a hollow portion thereof. Element 10: wherein the first and second expanded metal structural pillars are first and second concrete tubulars having expanded metal columns in a hollow portion thereof. Element 11: wherein the first and second expanded metal structural pillars are first and second steel or composite tubulars that are not configured to expand in response to hydrolysis having expanded metal columns in a hollow portion thereof. Element 12: wherein the first and second expanded metal structural pillars are in direct contact with the ground. Element 13: wherein the first and second expanded metal structural pillars include residual unreacted metal configured to expand in response to the hydrolysis. Element 14: wherein placing first and second expandable metal structural pillars into the ground by a distance ($d_1$), includes placing first and second expandable metal structural pillars into a body of the reactive fluid and into the ground by a distance ($d_1$). Element 15: wherein the body of the reactive fluid is a body of salt water. Element 16: wherein each of the first and second expandable metal structural pillars includes a first pier portion located within the ground by the distance ($d_1$), and a second column portion extending over the ground by a distance ($d_2$). Element 17: further including spanning the first and second expanded metal structural pillars with one or more beams. Element 18: further including coupling a first headstock to an upper end of the first column portion, and coupling a second headstock to an upper end of the second column portion, the one or more beams coupled to the first and second headstocks and spanning the first and second expanded metal structural pillars. Element 19: further including positioning an adapter plate between at least one first pier portion and at least one second column portion, the adapter plate configured to keep the at least one first pier portion and the at least one second column portion aligned. Element 20: wherein placing a first expandable metal structural pillar into ground by a distance ($d_1$) includes supplying fluid through a fluid passageway in the first expandable metal structural pillar while it is being pressed into the ground, the fluid forming an opening in the ground for the first expandable metal structural pillar. Element 21: wherein the first and second expandable metal structural pillars include one or more metal reinforcement members positioned therein. Element 22: wherein the one or more metal reinforcement members are one or more reinforcement rods extend along a length (l) thereof. Element 23: wherein the first and second expanded metal structural pillars include non-expanding strengthening particulates randomly dispersed therein. Element 24: wherein the non-expanding strengthening particulates include pieces of steel, pieces of composite or fibers. Element 25: wherein the first and second expanded metal structural pillars are first and second expanded metal tubulars having concrete located in a hollow portion thereof. Element 26: wherein the first and second expanded metal structural pillars are first and second concrete tubulars having expanded metal columns in a hollow portion thereof. Element 27: wherein the first and second expanded metal structural pillars are first and second steel or composite tubulars that are not configured to expand in response to hydrolysis having expanded metal columns in a hollow portion thereof. Element 28: wherein the first and second expanded metal structural pillars are in direct contact with the ground. Element 29: wherein the first and second expanded metal structural pillars include residual unreacted metal configured to expand in response to the hydrolysis.

Those skilled in the art to which this application relates will appreciate that other and further additions, deletions, substitutions, and modifications may be made to the described embodiments.

What is claimed is:

1. A support structure, comprising:

first and second expanded metal structural pillars positioned within the ground by a distance ($d_1$), the first and second expanded metal structural pillars comprising a metal that has expanded in response to hydrolysis; and one or more beams spanning the first and second expanded metal structural pillars.

2. The support structure as recited in claim 1, wherein each of the first and second expanded metal structural pillars includes a first pier portion located within the ground by the distance ($d_1$), and a second column portion extending over the ground by a distance ($d_2$).

3. The support structure as recited in claim 2, wherein the second column portion of each of the first and second expanded metal structural pillars is located at least partially within a body of water.

4. The support structure as recited in claim 3, further including an adapter plate positioned between at least one first pier portion and at least one second column portion, the adapter plate configured to keep the at least one first pier portion and the at least one second column portion aligned.

5. The support structure as recited in claim 2, further including a first headstock coupled to an upper end of the first column portion, and a second headstock coupled to an upper end of the second column portion, the one or more beams coupled to the first and second headstocks and spanning the first and second expanded metal structural pillars.

6. The support structure as recited in claim 1, wherein the first and second expanded metal structural pillars include one or more metal reinforcement members positioned therein.

7. The support structure as recited in claim 6, wherein the one or more metal reinforcement members are one or more reinforcement rods extend along a length (l) thereof.

8. The support structure as recited in claim 1, wherein the first and second expanded metal structural pillars include non-expanding strengthening particulates randomly dispersed therein.

9. The support structure as recited in claim 8, wherein the non-expanding strengthening particulates include pieces of steel, pieces of composite or fibers.

10. The support structure as recited in claim 1, wherein the first and second expanded metal structural pillars are first and second expanded metal tubulars having concrete located in a hollow portion thereof.

11. The support structure as recited in claim 1, wherein the first and second expanded metal structural pillars are first and second concrete tubulars having expanded metal columns in a hollow portion thereof.

12. The support structure as recited in claim 1, wherein the first and second expanded metal structural pillars are first and second steel or composite tubulars that are not configured to expand in response to hydrolysis having expanded metal columns in a hollow portion thereof.

13. The support structure as recited in claim 1, wherein the first and second expanded metal structural pillars are in direct contact with the ground.

14. The support structure as recited in claim 1, wherein the first and second expanded metal structural pillars include residual unreacted metal configured to expand in response to the hydrolysis.

15. A method for forming a support structure, comprising:

placing first and second expandable metal structural pillars into ground by a distance ($d_1$), the first and second expandable metal structural pillars offset from one another, wherein at least a portion of the first and second expandable metal structural pillars comprises a metal configured to expand in response to hydrolysis; and allowing the first and second expandable structural pillar to be exposed to reactive fluid to form first and second expanded metal structural pillars located at least partially within the ground.

16. The method as recited in claim 15, wherein placing first and second expandable metal structural pillars into the ground by a distance ($d_1$), includes placing first and second expandable metal structural pillars into a body of the reactive fluid and into the ground by a distance ($d_1$).

17. The method as recited in claim 16, wherein the body of the reactive fluid is a body of salt water.

18. The method as recited in claim 15, wherein each of the first and second expandable metal structural pillars includes a first pier portion located within the ground by the distance ($d_1$), and a second column portion extending over the ground by a distance ($d_2$).

19. The method as recited in claim 18, further including spanning the first and second expanded metal structural pillars with one or more beams.

20. The method as recited in claim 19, further including coupling a first headstock to an upper end of the first column portion, and coupling a second headstock to an upper end of the second column portion, the one or more beams coupled to the first and second headstocks and spanning the first and second expanded metal structural pillars.

21. The method as recited in claim 18, further including positioning an adapter plate between at least one first pier portion and at least one second column portion, the adapter plate configured to keep the at least one first pier portion and the at least one second column portion aligned.

22. The method as recited in claim 15, wherein placing a first expandable metal structural pillar into ground by a distance ($d_1$) includes supplying fluid through a fluid passageway in the first expandable metal structural pillar while it is being pressed into the ground, the fluid forming an opening in the ground for the first expandable metal structural pillar.

23. The method as recited in claim 15, wherein the first and second expandable metal structural pillars include one or more metal reinforcement members positioned therein.

24. The method as recited in claim 23, wherein the one or more metal reinforcement members are one or more reinforcement rods extend along a length (l) thereof.

25. The method as recited in claim 15, wherein the first and second expanded metal structural pillars include non-expanding strengthening particulates randomly dispersed therein.

26. The method as recited in claim 25, wherein the non-expanding strengthening particulates include pieces of steel, pieces of composite or fibers.

27. The method as recited in claim 15, wherein the first and second expanded metal structural pillars are first and second expanded metal tubulars having concrete located in a hollow portion thereof.

28. The method as recited in claim 15, wherein the first and second expanded metal structural pillars are first and second concrete tubulars having expanded metal columns in a hollow portion thereof.

29. The method as recited in claim 15, wherein the first and second expanded metal structural pillars are first and second steel or composite tubulars that are not configured to expand in response to hydrolysis having expanded metal columns in a hollow portion thereof.

30. The method as recited in claim 15, wherein the first and second expanded metal structural pillars are in direct contact with the ground.

31. The method as recited in claim 15, wherein the first and second expanded metal structural pillars include residual unreacted metal configured to expand in response to the hydrolysis.

* * * * *